United States Patent [19]

Klein

[11] Patent Number: 4,776,748

[45] Date of Patent: Oct. 11, 1988

[54] RECEPTACLE TRANSPORTING VEHICLE

[75] Inventor: Richard D. Klein, Jacksonville, Tex.

[73] Assignee: Klein Equipment, Inc., Jacksonville, Tex.

[21] Appl. No.: 912,937

[22] Filed: Sep. 29, 1986

[51] Int. Cl.[4] ..... B60P 3/00

[52] U.S. Cl. ..... 414/460; 294/119.4; 414/498; 414/917

[58] Field of Search ..... 414/460, 425, 419, 420, 414/421, 917, 498; 294/119.4; 298/38

[56] References Cited

U.S. PATENT DOCUMENTS

| | | | |
|---|---|---|---|
| 3,378,155 | 4/1968 | Steiner | 414/420 X |
| 3,958,707 | 5/1976 | Deppe | 414/498 X |
| 4,105,130 | 8/1978 | Hardwick et al. | 414/421 |
| 4,122,961 | 10/1978 | Kress | 414/420 |
| 4,601,630 | 7/1986 | Kress et al. | 414/460 |
| 4,624,618 | 11/1986 | LaBerdia et al. | 414/421 X |

*Primary Examiner*—Robert J. Spar
*Assistant Examiner*—Stuart J. Millman
*Attorney, Agent, or Firm*—Ronald B. Sefrna

[57] ABSTRACT

The present invention provides a tractor-trailer vehicle for use in transporting ladles of molten metal. The trailer includes a generally U-shaped main frame, each side carrying a wheel assembly and a carrier beam pivotally interconnected at one end to the side. A transverse U-shaped overhead beam pivotally interconnects at each end to the carrier beams intermediate their ends, and has parallel ladle trunnion-engaging hooks pendantly disposed therefrom. Actuators interconnected between the main frame and the other end of the carrier beams provide a lever action rotating the carrier and overhead beams about the carrier beam-main frame pivot connection. The actuators are gimbaled to prevent load-induced binding. Upon such beam rotation, the overhead beam and hooks move substantially vertically to lift and lower the ladle from and to its supporting surface, respectively. Stabilizer rods extending between the overhead beam and the main frame cause the overhead beam to pivot about its interconnections during rotation of the carrier beams. The overhead beam and hooks are thus maintained in a constant vertical alignment providing substantially vertical lifting and lowering forces on the ladle trunnions. A ladle restraining assembly is provided to substantially eliminate movement induced swinging of ladle during transport.

14 Claims, 19 Drawing Sheets

RECEPTACLE TRANSPORTING VEHICLE

FIELD OF THE INVENTION

This invention relates generally to apparatus for transporting heavy loads and, more particularly, relates to wheeled vehicles for picking up, suppoting, and carrying ladles of the type used in the steel-making industry.

BACKGROUND OF THE INVENTION

In the commercial production of steel or the like, it is frequently necessary to transport large quantities of molten material about the plant situs and accordingly various systems have been devised for so doing.

As but one example, during the course of such metal production molten slag material is generated which must be separated and transported to a slag pile for storage. Accordingly, large containers known as slag pots were developed for containing the slag as well as special purpose vehicles designed for lifting the pots, transferring them to a remote location, and then effecting the dumping of the slag from the pot. A representative such vehicle may be seen depicted in U.S. Pat. No. 4,105,130 to Hardwick, et.al.

A review of the aforementioned patent and like references indicated that the general approach with respect to slag pot carrier vehicles was generally to lift and support such pots, often circumferentially or from the bottom thereof, to transport them to a desired location, and thence to provide some means for tipping the slag pot off the verticle so as to effect pouring of the molten contents onto the slag heap.

Such approach appeared to work reasonably well with small slag containers of up to 250 tons. However, different design constraints and problems arose when attempting to transport larger quantities of molten metal which would often range in excess of 400 gross tons.

Containers for transporting such loads (known as ladles in the steel production industry), as well as the resultant loads themselves were so large as to suggest that more practical means other than wheeled vehicles be employed for the lifting and lateral movement of such ladels. Numerous problems associated with loads of such magnitude and other requirements of ladle transport systems suggested a wheeled vehicle approach to be unfeasible. First, tremendous lifting forces on the ladle trunnions from such a vehicle would have to be provided which were substantially vertical in like manner to those provided by an overhead crane to avoid shearing forces on the trunnions. Secondly, problems in distributing loads of this magnitude during the lifting and transporting, in order to avoid load moments exceeding the capacity of the support members and the like (such as tires, wheels, axles, hydraulic cylinders, etc.), appeared to be virtually insurmountable.

Accordingly, for these reasons it became conventional to simply provide for vertically lifting, lowering, supporting, and laterally moving such ladles by means of an overhead crane hooked onto opposing trunnions extending radially outwards of the ladle. the ladle would thus be vertically lifted by the crane and transported along the crane tracks to a desired location where the molten metal could then be formed into ingots which where then subsequently transferred to an appropriate rolling or slab mill plant as required.

However, with the advent of more modern metal production facilities and the need to conserve energy, plant designs began to appear which bypassed the ingot stage. In such cases, the molten metal had to frequently be transported substantial distances to the situs of the next operation. In such instances, it became readily apparent that the use of an overhead crane for ladle transport was impractical and accordingly other transport systems were sought after.

One such ladle transport system called for an overhead crane which would merely lift the ladle onto a specially designed rail car. The car would then move along tracks to a desired location, whereupon a crane would then remove the ladle from the car.

However, several serious problems are associated with such a system. First, the system was expensive, requiring substantial capital outlay for the cranes, rail tracks, rail car, and attendant labor costs for operation. Secondly, the system was inflexible once the tracks were laid and confining in terms of plant layouts, inasmuch as the turn radius for cars was relatively substantial. Moreover, such an approach was difficult to retrofit into existing plant layouts and operations.

From the foregoing, it is apparent that a ladle transporter was needed which, among other features, was inexpensive relative to other systems, flexible, and provided for substantially vertical lifting and lowering forces on the ladle trunnions.

SUMMARY OF THE INVENTION

The present invention provides a tractor-trailer vehicle for use in transporting ladles of molten metal. A gooseneck hitch assembly interconnects the tractor to a modified U-shaped trailer main frame. The main frame is comprised of a main member and two parallel side members rigidly interconnected at first ends to the ends of the main member and terminating in second ends. First and second carrier beams each having first and second ends are disposed above each side of the main frame and pivotally interconnected at the second beam ends to respective second ends of each main frame side.

A U-shaped overhead beam aligned transversely to the carrier beams has each end pivotally interconnected to a respective one of the carrier beams intermediate the first and second ends thereof. A pair of ladle trunnion engaging hooks are pendantly disposed in parallel from the overhead beam. First and second actuators are interconnected between the main frame and the first end of each of the carrier beams, respectively, and cause rotation of the carrier and overhead beams about the second ends of the carrier beams. The actuators are gimbaled to prevent load-induced binding thereof.

Upon such rotation, the hooks move upwards engaging the ladle trunnions of a ladle disposed within the main frame. The ladle is thereby lifted from its resting surface, whereupon the tractor is engaged to transport the ladle to the desired location. Upon operating the actuators to cause such rotation in the opposite direction, the hooks move downwards so as to dispose the ladle on the ground surface and disengage the hooks from the ladle trunnions.

First and second stabilizer rods extend between the overhead beam and each second end of the side members of the main frame, respectively, and are pivotally interconnected to the respective side members and the overhead beam. The overhead beam and hooks are thereby maintained in a substantially constant vertical alignment during rotation of the overhead beam about the second ends of the carrier beams. The forces introduced by the hooks on the trunnions to lift and lower the ladle are thereby substantially vertical at all times and accordingly similar to those introduced by conventional cranes or the like.

Ladle restraining means rearwardly disposed from the main member of the main frame are provided to substantially eliminate movement induced swinging of the ladle during transport.

These and other features are provided by the present invention which may be more readily understood with reference to the accompanying drawings wherein:

DETAILED DESCRIPTION OF THE INVENTION

Figure 1:
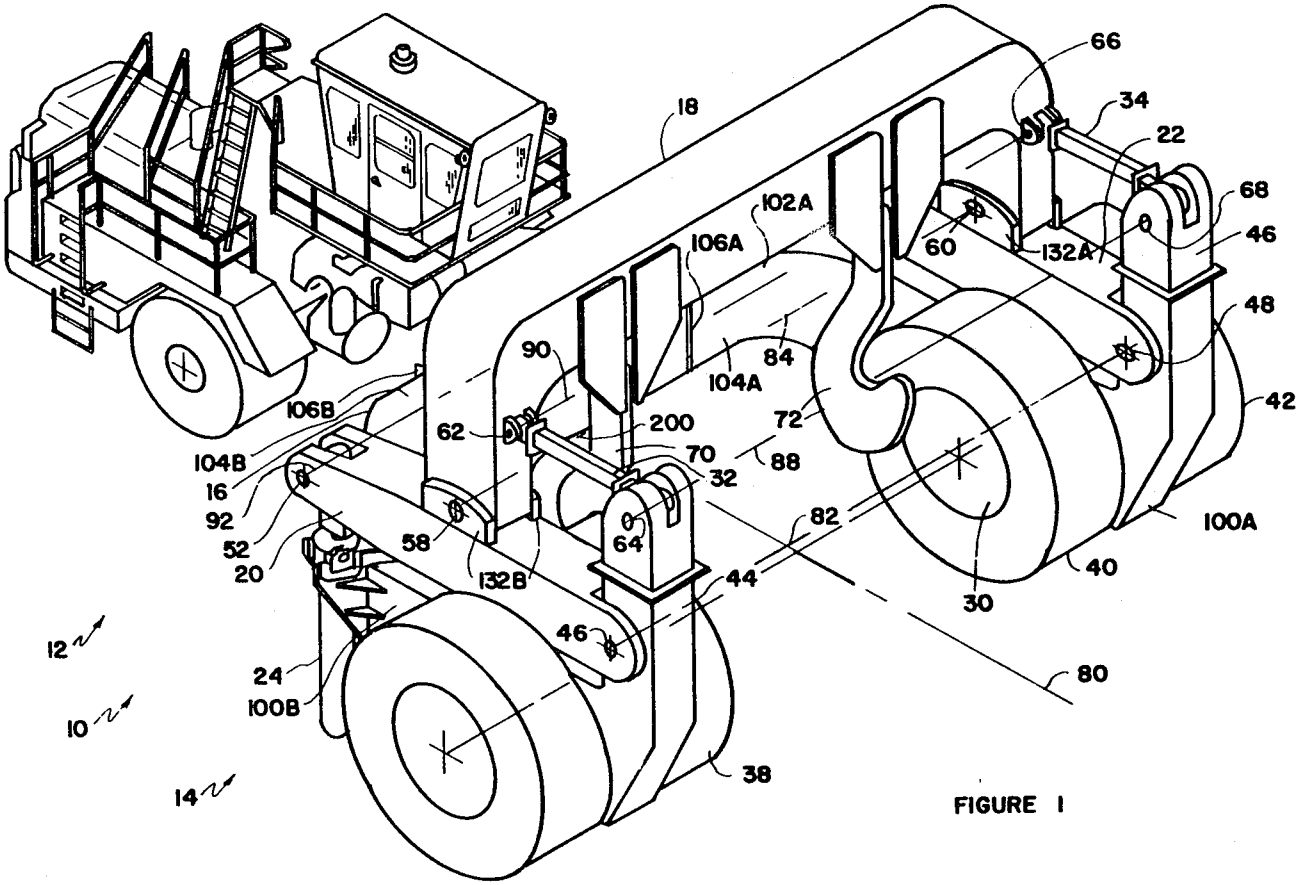
FIG. 1 is a pictorial illustration of the preferred embodiment of the ladle transporter of the present invention.

With reference to FIG. 1, a general description of the main components and operation of the ladle transporter 10 of the present invention will be given followed by a more detailed description of the individual components thereof. It will be noted in passing that the transporter 10 is generally symmetrical about a longitudinal axis 80. Accordingly, components lying on one side of the axis will generally correspond to identical mated components on the other side thereof. Thus, unless hereinafter noted to the contrary, description of one component will generally be equally applicable to the matched component.

The transporter 10 will be seen to be comprised of a prime mover 10 such as a tractor hingedly interconnected by means of a gooseneck hitch assembly 78 to a trailer 14. The trailer preferably includes a main frame assembly 16 defining a modified U-shape lying in a horizontal plane, an overhead beam assembly 18 defining a U-shape lying in a vertical plane, and a pair of parallel carrier beams 20 and 22.

The carrier beams 20 and 22 are each pivotally pinned at one end to respective ends of the main frame 16. Gimbaled actuators 24 and 26 are interconnected to the remaining end of each carrier beam 20 and 22 and to the main frame assembly 16. Upon actuation of the actuators, it will be appreciated that these remaining ends of carrier beams 20 and 22 may be caused to rotate about their pinned connections to the main frame assembly 16 and about a first axis 82 extending through such connections. Moreover, such rotation will generally be in parallel planes perpendicular to such axis 82. Each end of the overhead beam assembly 18 is pivotally pinned to a respective one of the carrier beams 20 and 22 at a location intermediate the ends of the beams 20 and 22. In this manner, upon rotation of the carrier beams 20 and 22 about first axis 82, the beam assembly 18 will also rotate about this axis 82 as well as rotating about a second axis 84 parallel to the first axis 82 in a manner to be described. This second axis 84 extends coaxially through the aforementioned pinned connections between the overhead beam assembly 18 and the carrier beams 20 and 22.

Stabilizer rods 32 and 34 are further provided which are pivotally pinned at opposing ends each to a respective side of the overhead beam assembly 18 and a respective end of the main frame assembly 16. A primary function of these rods 32 and 34 is to maintain substantially constant alignment of overhead beam assembly 18 in the aforementioned vertical plane as the beam assembly 18 and carrier beams 20 and 22 are made to rotate about first axis 82 in the hereinbefore-noted manner.

A pair of ladle trunnion-engaging hooks 70 and 72 are pendantly disposed in parallel alignment downwards from the overhead beam assembly 18 on either side of the longitudinal axis 80. Due to the aforementioned substantially constant vertical alignment of the beam assembly 18, these hooks 70 and 72 will, in like manner, remain in such vertical alignment during rotation about first axis 82.

Axle assemblies 28 and 30 extend through respective ends of main frame assembly 16 in coaxial alignment with a third axis 86 parallel to the first and second axes 82 and 84, respectively. Axle assembly 28 carries disposed on either side of the respective main frame assembly 16 end a plurality of pneumatic tires 36 and 38. In like manner, axle assembly 30 also carries a plurality of tires 40 and 42.

Also with respect to the preferred embodiment of FIG. 1, it will be noted that the stabilizer rods 32 and 34 will be disposed in a generally parallel orientation whereby first ends thereof are pivotally pinned to the aforementioned pin columns 44 and 46 so as to be in coaxial alignment with and rotatable about a fourth axis 88. Similarly, the opposing ends of the stabilizer rods 32 and 34 pinned to the overhead beam assembly 18 will also be in coaxial alignment along a fifth axis 90 and rotatable thereabout. Finally, the aforementioned pinned interconnection between the hydraulic actuators 24 and 26 respective carrier beams 20 and 22 will preferably occur in coaxial alignment along a sixth axis 92, the aforesaid fourth, fifth and sixth axes 88, 90, and 92, respectively, being parallel to the previously noted first, second, and third axes 92, 84, and 86 respectively.

Even without further detailed description of the transporter 10 of the present invention, several significant advantageous features of its novel design may be noted. First, by providing pivoting pinned connections of the ends of carrier beams 20 and 22 to the main frame assembly 16 and rotating the opposing ends thereof by means of hydraulic actuators 24 and 26, a lever action is provided for lifting and lowering the overhead beam assembly 18 disposed intermediate the ends of carrier beams 20 and 22. In this manner, the deadlift load on the hydraulic cylinders of actuators 24 and 26 is substantially reduced.

Secondly, due to the operation of the pivoting pinned connections of the overhead beam assembly 18 to the carrier beams 20 and 22 and the operation of the just-described stabilizer rods 34 and 36, as well as the aforementioned lever action, movement of the overhead beam assembly 18 and trunnion hooks 70 and 72 is substantially vertical, thus simulating the desirable vertical lifting action of overhead cranes of the prior art against the ladle trunnions.

Still further, it will be appreciated that the loading on trailer 14 provided by the ladles may vary tremendously from loads at times exceeding 400 gross tons (in the case of a full teaming ladle) to the relatively light load of an emptied ladle.

Due to the magnitude of such load ranges, it will further be appreciated that the various hereinbefore described trailer 14 components will accordingly undergo dimensional changes from the load variations which might otherwise adversely affect their working relationships. In particular, for example, the tremendous loading intermediate the ends of the overhead beam assembly 18 result in varying torques on the carrier beams 20 and 22 which might otherwise result in binding of the actuators 24 and 26. However, by providing the hereinbefore described pinned connections between the components as well as the gimbaling in two degrees of freedom and particular orientation of the actuators 24 and 26 to be hereinafter described in greater detail, such binding is substantially eliminated.

Now that a general description of the main components of trailer 14 and their interrelationship has been provided, a typical operation of the transporter 10 will be described.

It will be recalled that the main purpose of transporter 10 is to transport a teaming ladle of molten metal of the type employed, for example, in the steel production industry. Such ladles generally include a pair of trunnions extending radially outwards from opposing side of the ladle in coaxial alignment.

Thus the transporter 10 is first intended to engage and vertically lift the ladle from the resting position, such as adjacent a steel production furnace. Next, the transporter 10 is employed to move the ladle horizontally along a haul road or the like to a desired remote location as, for example, adjacent a casting facility, whereupon the ladle is thence to be lowered by and disengaged from the transporter 10.

With the foregoing in mind, the transporter 10 will first be backed into position wherein the ladle is positioned within the U-shape defined by the main frame 16, with the trunnions positioned over the respective eye-hooks disposed from the overhead beam assembly 18.

Further due to the magnitude of such load ranges, and the pendant disposition of the ladle within the main frame, it will be appreciated that swinging movement of the ladle in transport is undesirable in that such movement will impose unbalanced forces on both ladle trunnions and the various components of trailer 14. However, by providing ladle restraining means, to be hereinafter described in greater detail, such swinging movement is substantially eliminated. The actuators, which in the preferred embodiment of the invention are hydraulic, are thence activated preferably by introducing a source of pressurized hydraulic fluid therein.

The carrier beams 20 and 22 and overhead beam assembly 18 thereupon begin to rotate about first axis 82 from the position shown in FIG. 1, whereby the eye-hooks are moved generally vertically upwards into mating engagement with respective trunnions. Upon further such rotation of the carrier beams 20 and 22 and overhead beam assembly 18 by continued activation of actuators 24 and 26, the ladle is thereby lifted off its resting surface.

The ladle restraining means are then, activated, thereby damping swinging movement of the ladle through the degree of freedom permitted by its pendant disposition within the main frame of transporter 10. The tractor 12 may then be employed to move the trailer 14 and the ladle to a desired location, whereupon the previously noted procedure is reversed so as to reposition the ladle again on a resting surface and disengage the eye-hooks therefrom.

It will be appreciated that the aforementioned pivotal pinned connection between the various components herein described may be provided by the pins 52–68. Moreover, in a preferred embodiment of the present invention, pin column 44 and 46 portions of the main frame assembly 16 may be provided extending generally vertically upwards from the locations at which the carrier beams 20 and 22 are pivotally interconnected to the main frame assembly 16. At the uppermost ends of such pin columns 44 and 46 the aforementioned pinned and pivoting connection to the stabilizer rods 32 and 34 are made.

A more detailed description of the various hereinbefore noted components of the transporter 10 will now be disclosed with reference to the accompanying Figures. It will be recalled that the transporter 10 is generally symmetrical about its longitudinal axis 80. Accordingly, when reference numbers are utilized which include the designation "A", this will refer to aspects of components relating to the right side of the transporter 10 and corresponding components will also exist for the left hand portion thereof. Identical reference numbers carrying the designation "B" will refer to correlative aspects of corresponding components on the opposite side of the longitudinal axis 80.

Figure 2:
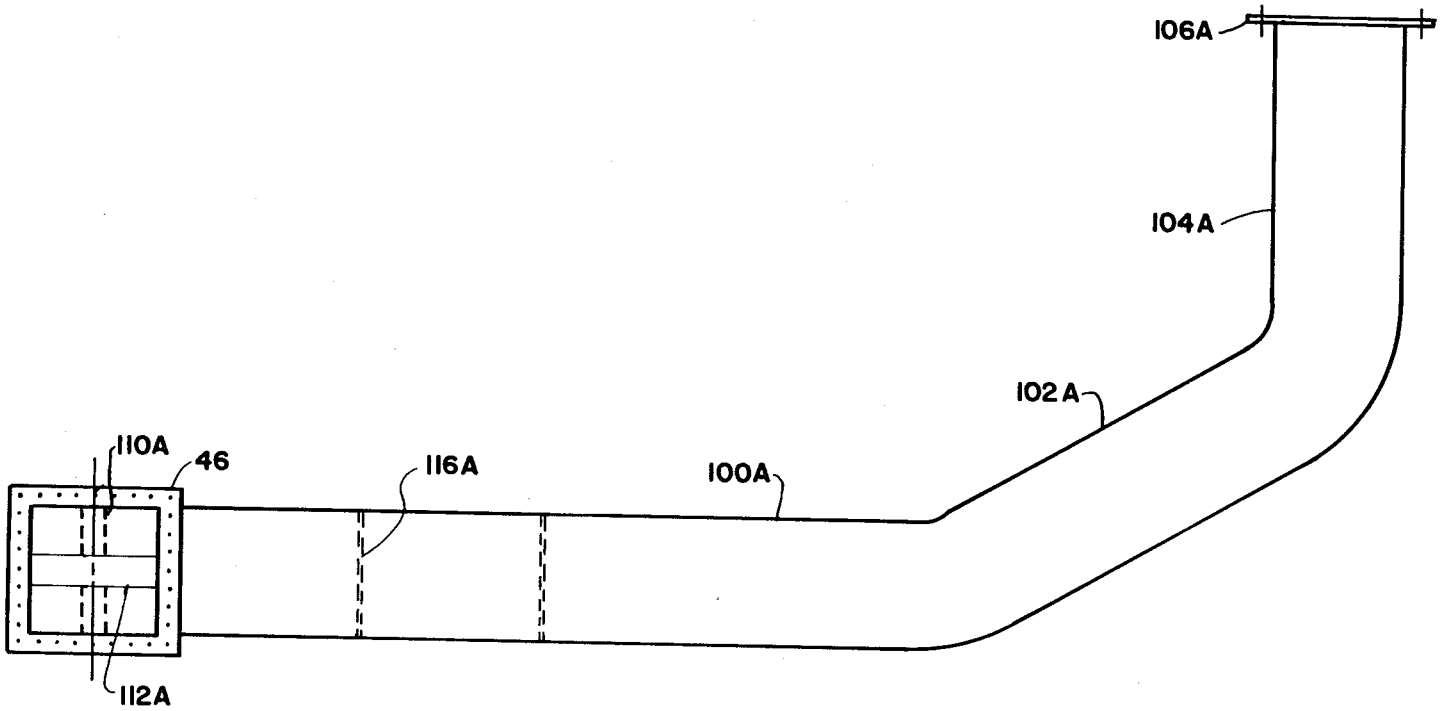
FIG. 2 is a plan view of one half-section of the main frame of the transporter depicted in FIG. 1.
Figure 3:
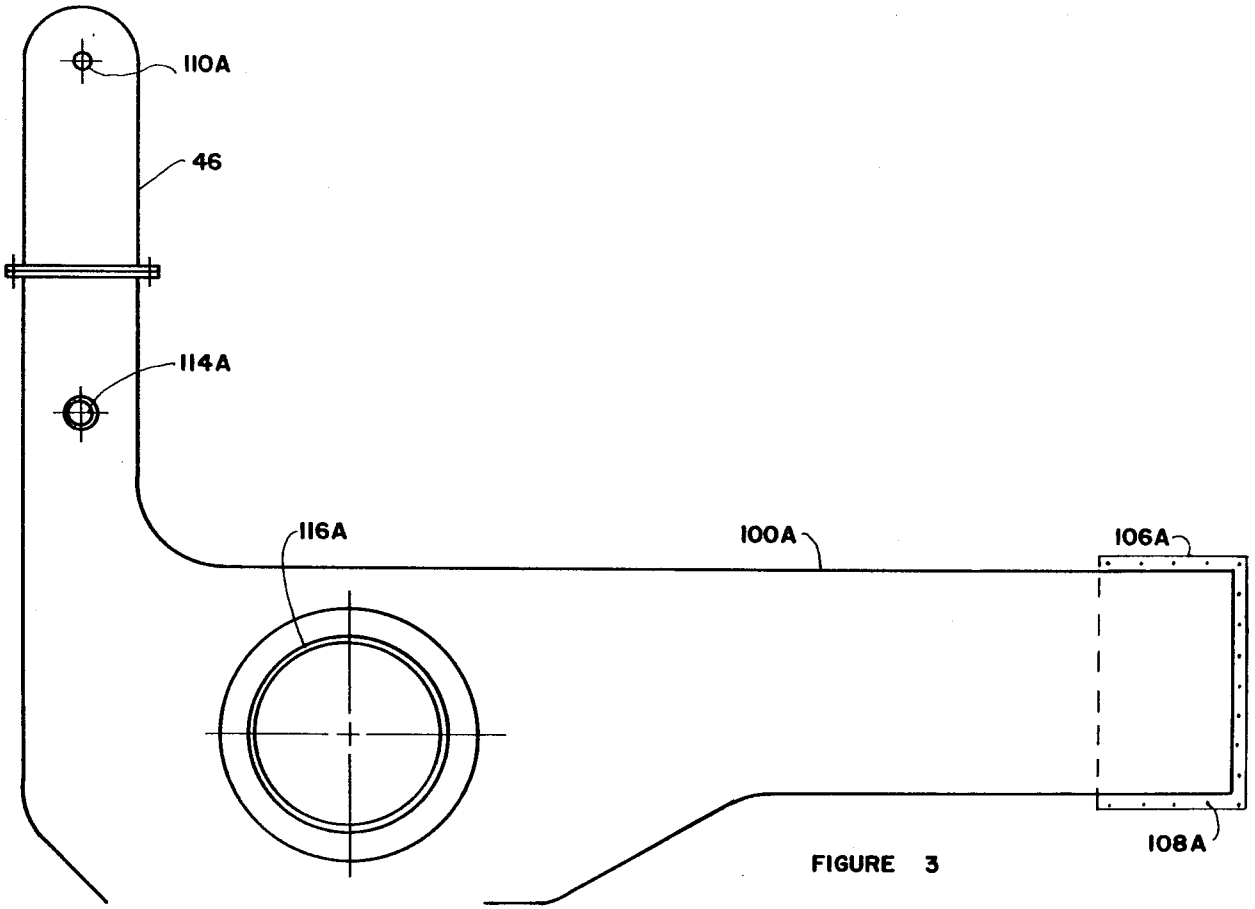
FIG. 3 is an elevation view of the main frame half-section depicted in FIG. 2.

With reference to FIG. 2, the right hand half of the main frame assembly 16 will be seen to include a first section 100A, a second section 102A disposed at an angle relative to the first section, and a third section 104A aligned with its longitudinal axis generally perpendicular to that of the first section 100A. Disposed on the end of third section 104A is a flange 106A, the purpose of which is to matingly engage a corresponding flange 202 of a main frame mid-section 200 of main frame assembly 16 to be hereinafter described with respect to FIG. 10–12. With reference to FIG. 3, the flanges 106A and 202 will be provided with a plurality of bolts holes 108A and 108B which may be matingly aligned to receive appropriate bolts whereby the two half sections may be rigidly attached so as to comprise the main frame 16 as depicted in FIG. 1. A similar flanged and bolted interconnection will be provided between flange 204 of midsection 200 and a flange 106B of the symmetrical left hand section of main frame assembly 16.

Disposed at the end of the first section 100A is the aforementioned pin column 46 which extends generally vertically from the end of the first section 100A. This right hand pin column 46 at the upper end thereof preferably defines apertures 110A (for receiving pin 68) and a stabilizer rod receiving slot 112A. In this manner, the stabilizer rod 34 may be received by the slot 112A whereby the pin 68 may be extended through the apertures 110A and the end of the stabilizer rod 34 so as to cause the rod 34 to be in pivotal engagement about this pin 68.

Referring to FIG. 3 which is an elevation view of the right hand half section of main frame assembly, the pin column 46 thereof will further be seen to include apertures 114A for receiving pin 48 whereby the right hand carrier beam 22 may thus be pivotally disposed about the pin column 46 in a manner previously described. Still further, the first section 100A of the right half section of the main frame assembly 16 will further be seen to include an axle aperture 116A for receiving the axle assembly 30 therethrough which, in turn, it will be recalled, preferably supports a plurality of pneumatic tires 40 and 42.

Figure 4:
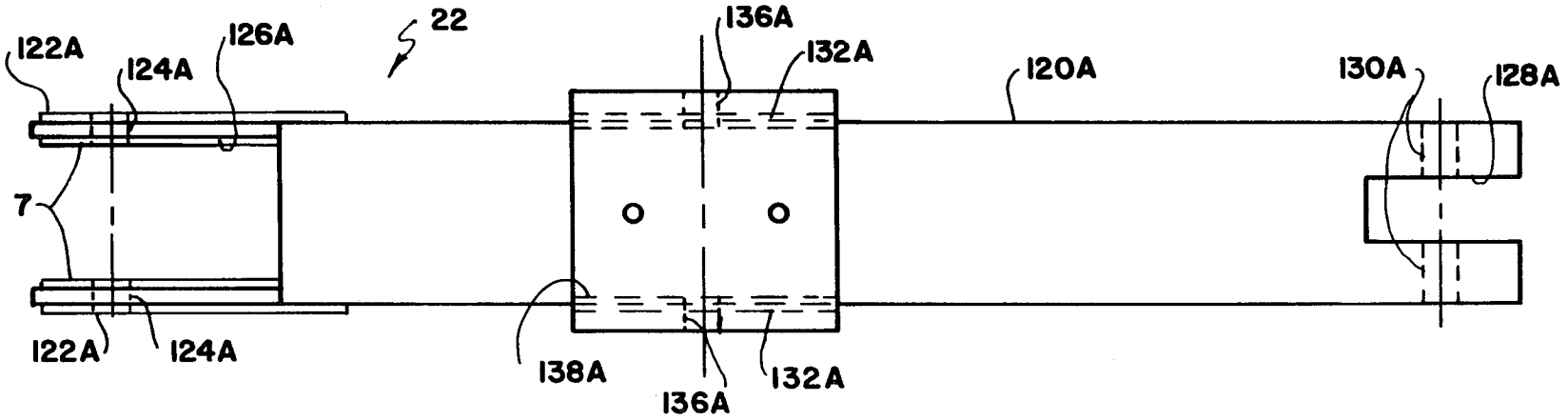
FIG. 4 is a plan view of a carrier beam assembly of the transporter depicted in FIG. 1.
Figure 5:
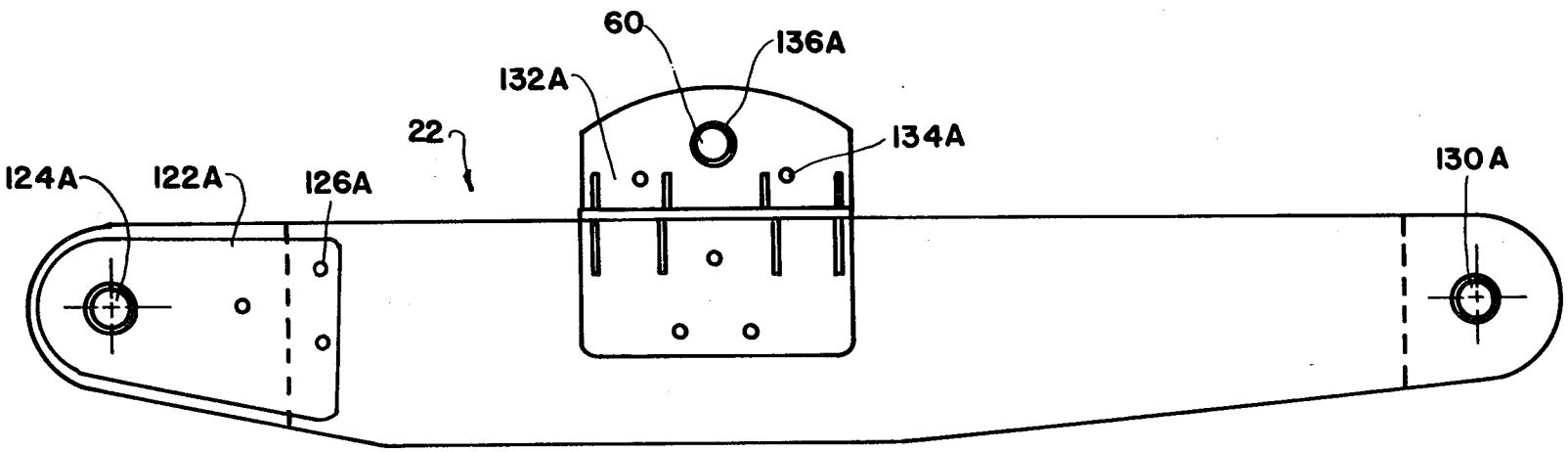
FIG. 5 is an elevation view of the carrier beam assembly depicted in FIG. 4.

Referring now to FIGS. 4 and 5, there will be seen depicted therein a right hand carrier beam 22 of the transporter 10. First with reference to FIG. 4, the carrier beam 22 will preferably include an elongate generally rectangular main beam 102A having disposed at one end thereof a pair of parallel plates 112A which define a slot therebetween for receiving the pin column 46 in the manner illustrated in FIG. 1. These plates 122A will include apertures 124A extending therethrough in coaxial alignment which receives pin 48. The pin 48 also extends through the pin column 46 so as to establish pivotal relationship between the carrier beam 22 about the pin 48 and pin column 46 in a manner previously described. These plates 122A will preferably be rigidly attached to the main beam 120A by any convenient means such as bolts 126A.

The end of main beam 120A opposing the aforesaid plates 122A defines a slot 128A for receivig, preferably, a moving piston of hydraulic actuator 26 which may be pivotally attached to the beam 120A by means of a pin extending therethrough as well as extending through coaxially aligned apertures 130A which are disposed in the end of main beam 120A.

Intermediate the ends of main beam 120A, a pair of plates 132A are preferably provided which are rigidly attached to the main beam 120A again by any conventional means such as bolts 134A. These plates 132A define a pair of coaxially aligned apertures 136A as well as a slot 138A therebetween. Comparison of FIGS. 4 and 1 indicates that the purpose of this slot 138A is to receive a mating end of the overhead beam assembly 18. The apertures 136A are adapted to receive a pivot pin 60 whereby the end of overhead beam assembly 18 may pivot about the second axis 84 extending through these pins 60 (and pin 58 in the case of the left hand end of the beam assembly 18) for purposes previously described.

The overhead beam assembly 18 will now be described in greater detail with reference to the accompanying FIGS. 6–9.

Figure 6:
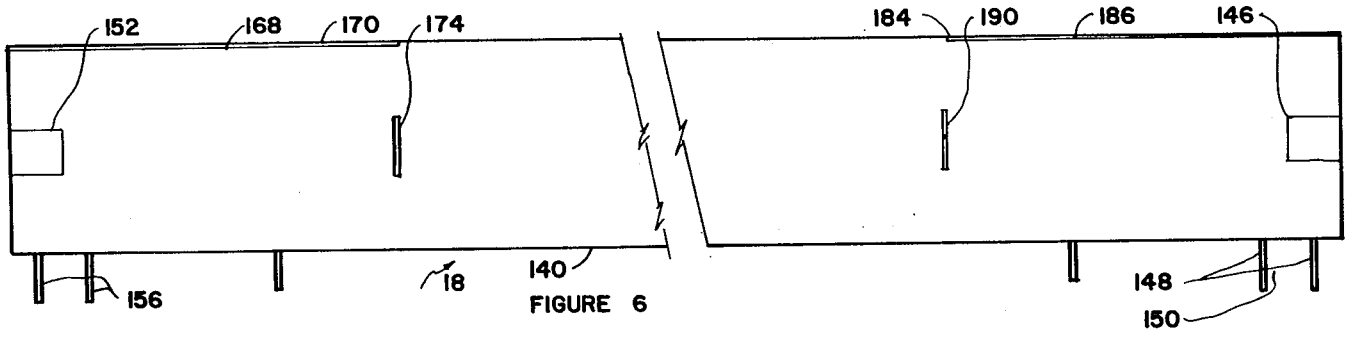
FIG. 6 is a plan view of the overhead beam assembly of the transporter depicted in FIG. 1.
Figure 7:
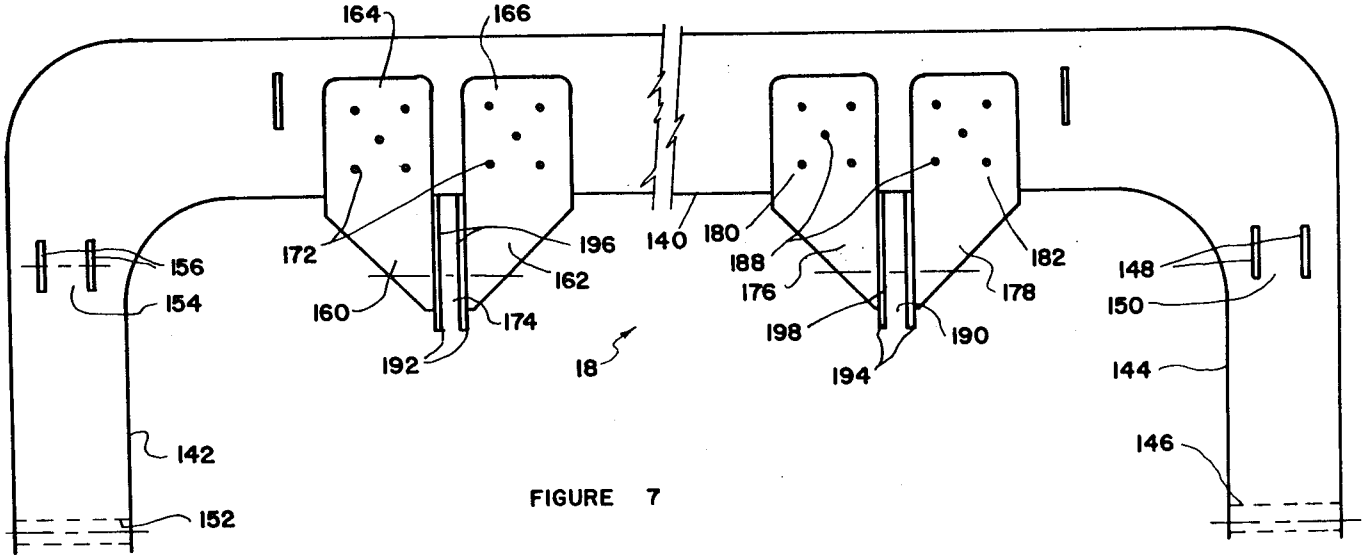
FIG. 7 is an elevation view of the overhead beam assembly of the transporter depicted in FIG. 1.

With reference to FIG. 6 and 7, the overhead beam assembly 18 will be seen to be comprised generally of an elongate rectangular main beam 140 having disposed in parallel relation at opposing ends thereof elongate rectangular end sections 142 and 144 perpendicular to the longitudinal axis of main beam 140. With reference first to the right hand side of FIG. 7, the end section 144 may be seen to have disposed therethrough an aperture 146 for receiving pin 60 which also extends through plates 132A of the carrier beam 22 so as to provide the aforementioned pivotal relation between beam assembly 18 and carrier beam 22. End section 144 also preferably carries a pair of flanges 148 having corresponding apertures 150 extending therethrough. The purpose of these apertures 150 is to receive pin 66 which also extends through the end of stabilizer rod 34.

In like manner, with reference to the left hand side of FIG. 7, and section 142 preferably includes apertures 152 extending through the end thereof for receiving pin 58 which extends through plates 132B of carrier beam 20. Also in like manner to the right hand section 144 of beam assembly 18, a pair of flanges 154 define apertures 156 extending therethrough which receive pin 62 which also extends through the end of stabilizer rod 32. In this manner, the aforementioned pivotal relation between beam assembly 18 and carrier beam 20 about pin 58 and second axis 84 is established as well as pivotal relation between beam assembly 18 and rod 32 about pin 62 and fifth axis 90.

Still referring to FIG. 6 and 7, a pair of prism-shaped members 160 and 162 are mounted on the main beam 140 intermediate the center of beam 140 and the end section 142 by means of four mounting plates 164–170 and corresponding bolts 172. A slot 174 is thereby defined by the surface portions of prism-shaped members 160 and 162 facing each other, whereby the slot 174 lies along a plane parallel to the inner faces of the prism-shaped members 160 and 162 and perpendicular to the axis of beam 140.

In like manner, a pair of prism-shaped members 176 and 178 are mounted on main beam 140 intermediate the center thereof and end section 144 by means of four mounting plates 180, 182, 184, and 186 and corresponding bolts 188. A slot 190 is thereby defined by the inner surface portions of prism-shaped members 176 and 178 which face each other whereby this slot 190 lies in a plane generally parallel to the plane in which the slot 174 lies.

Figure 8:
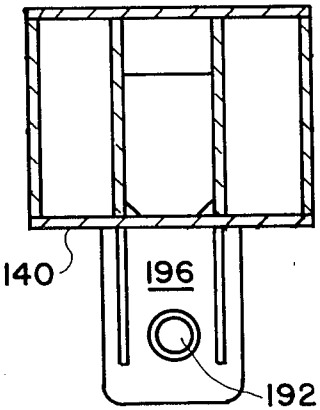
FIG. 8 is a view, in section, of the overhead beam assembly depicted in FIG. 7 taken along line A—A.
Figure 9:
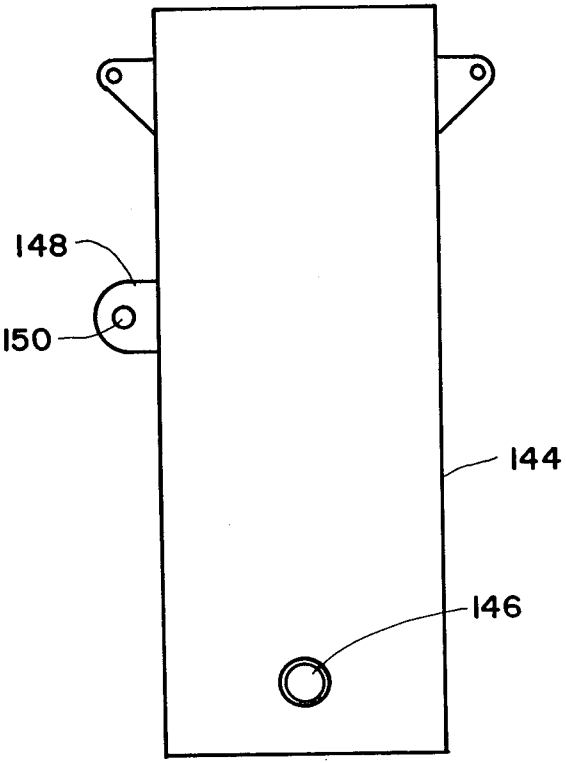
FIG. 9 is an end view of the overhead beam assembly of the tranporter depicted in FIG. 1.

These inner surfaces 196 of prism-shaped members 160 and 162 will have extending therethrough an aperture 192 lying in an axis generally parallel to the longitudinal axis of the main member 140, as maybe more clearly seen with reference to FIG. 8 which is a cross-sectional view of the main beam 140 taken along lines A—A. In a similar manner, these inner faces 198 of prism-shaped members 176 and 178 will have extending therethrough an aperture 194 in coaxial alignment with the aperture 192.

Reference to FIG. 1 will reveal the purposes of these apertures 192 and 194 as well as the slots 174 and 190. It will be recalled that trunnion hooks 70 and 72 are provided which are pendantly disposed from the beam assembly 18. More particularly, it will now be appreciated that the upper end of hook 70 may be of a generally flat configuration so that it may extend into slot 174. The end hook 70 will include an aperture which may align with aperture 192 to receive a pin so as to dispose the hook 70 from the beam assembly 18 in the desired manner. Similarly, the trunnion hook 72 may have a generally flat upper surface which may be disposed within the slot 192 and may further have an aperture extending therethrough which may be brought into coaxial alignment with the apertures 194 so as to receive a pin whereby the hook 72 may also be pendantly disposed from the beam assembly 18 as depicted in FIG. 1.

A detailed description of the actuators 24 and 26, their particular orientation and gimbaling in two degrees of freedom will now be provided. It will be recalled that the transporter 10 is generally symmetrical about its longitudinal axis, and it will be readily understood that actuators 24 and 26 are in mirrored relationship to each other. Accordingly, a description of the components and aspects relating to actuator 26 will correspond to the mirrored components and aspects for actuator 24.

Figure 11:
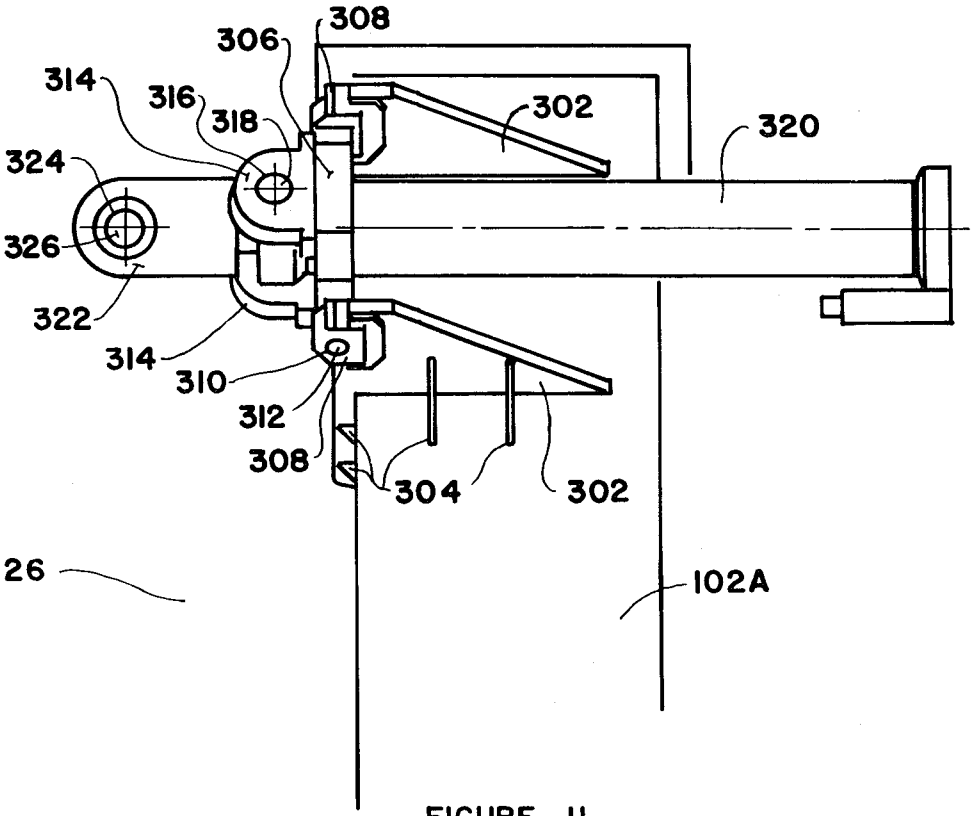
FIG. 11 is an elevational view of the preferred embodiment of the gimbaled actuator means affixed to the main frame of the transporter depicted in FIG. 1.
Figure 10:
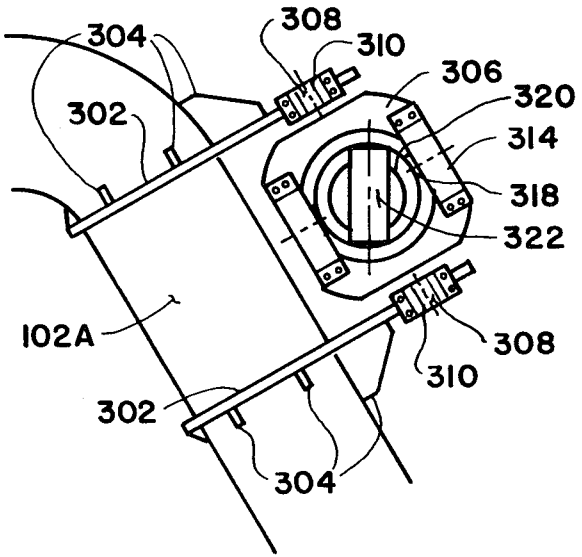
FIG. 10 is a plan view of the preferred embodiment of the gimbaled actuator means affixed to the main frame of the transporter depicted in FIG. 1.

Referring now to FIGS. 10 and 11, which depict actuator 26 in relation to main frame second section 102A, it will be seen that the actuator assembly includes a pair of parallel plates 301 which are rigidly attached to main frame second section 102A by any convenient conventional means. In the preferred embodiment depicted plates 302 are attached to main frame second section 102A by welding, but other conventional means, such as bolts, will suffice. Plates 302 are disposed intermediate the ends of main frame second section 102A so as to underly the end of main beam 120A containing slot 128A. In the preferred embodiment depicted, the actuator assembly further includes a plurality of generally triangular bracing plates 304 rigidly attached between plates 302 and main frame second section 102A and aligned perpendicular to the faces of plates 302 and main frame second section. Plates 302 define a slot therebetween which will receive mounting ring 306.

Mounting blocks 308 are firmly attached, by any convenient conventional means, to the top edges of plates 302, at or near the end of plates 302 farthest from main frame second section 102A. Mounting blocks 308 define apertures 310 coaxially aligned perpendicular to the surfaces of parallel plates 302, which will receive pins 312. Pins 312 extend through apertures 310 in mounting blocks 308 and are firmly attached to mounting ring 306 or may be formed as an integral part of the mounting ring. Mounting blocks 308 may be horizontally bifurcated along a plane which passes through apertures 310 and provided with means for firmly interconnecting the two resulting parts of the mounting blocks.

Still referring to FIGS. 10 and 11, the actuator assembly further includes mounting ring 306 disposed within the slot defined by parallel plates 302 and pivotally related thereto by means of pins 312 extending through apertures 310 in the mounting blocks as previously described. Mounting ring 306 comprises a flat ring of generally donut or torroidal section shape, including a substantially circular central opening of sufficient dimension to contain the actuator means. Pivot mounts 314 are firmly, though removeably, attached to the top surface of the mounting ring and define apertures 316 to receive pins 318. The pivot mounts are disposed upon the upper surface of mounting ring 306 such that the axis of apertures 316 is perpendicular to the lies above the axis of apertures 310. Pins 318 extend through apertures 316 and are firmly attached to actuator means 320, which will be disposed within and extend through the central opening in the mounting ridge. In the preferred embodiment, actuator means 320 comprises a hydraulic cylinder and position assembly. The upper end of actuator means 320, preferably a moveable hydraulic piston, is adapted to form connecting plate 322 which defines an aperture 324 to receive pin 326.

The actuating apparatus will be positioned such that the longitudinal axis of main beam 120A of transporter 10 perpendicularly intersects the axis of aperture 324, which axis is itself coincident with the axis of apertures 130A disposed in the end of main beam 120A. The actuating apparatus is pivotally connected to main beam 120A by means of pin 326 which extends through aperture 324 and through apertures 130A. Thus upon activation of the actuating means the actuating force is communicated through such pinned pivotal connection between the actuator 26 and carrier beam 22, producing the carrier beam rotation hereinbefore described. It will be readily understood that a like relation exists between actuator 24 and carrier beam 20, disposed on the left hand side of transporter 10.

The ladle restraining means will now be described in detail with reference to accompanying FIGS. 12, 13, 14, 15, 16, 17 and 18. The ladle restraining means generally comprises a hydraulically actuated and damped restraining arm and wear plate pivotally mounted on the main frame mid-section 200.

Figure 13:
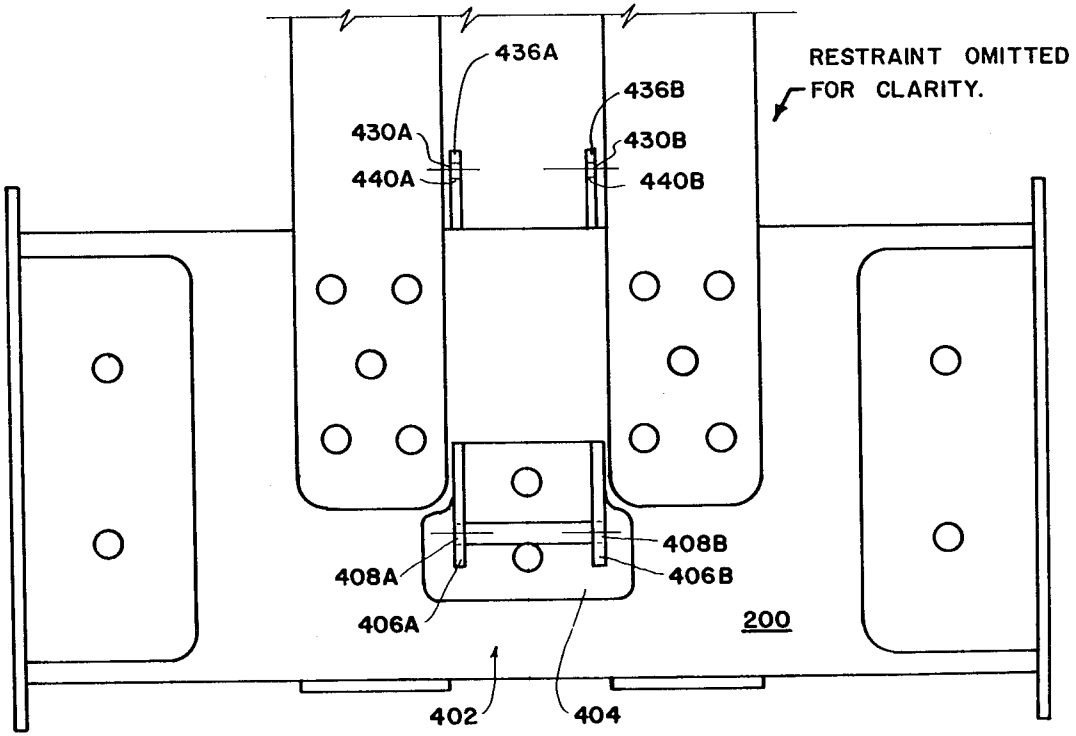
FIG. 13 is a front elevation view of the components of the ladle restraining means depicted in FIG. 12.
Figure 14:
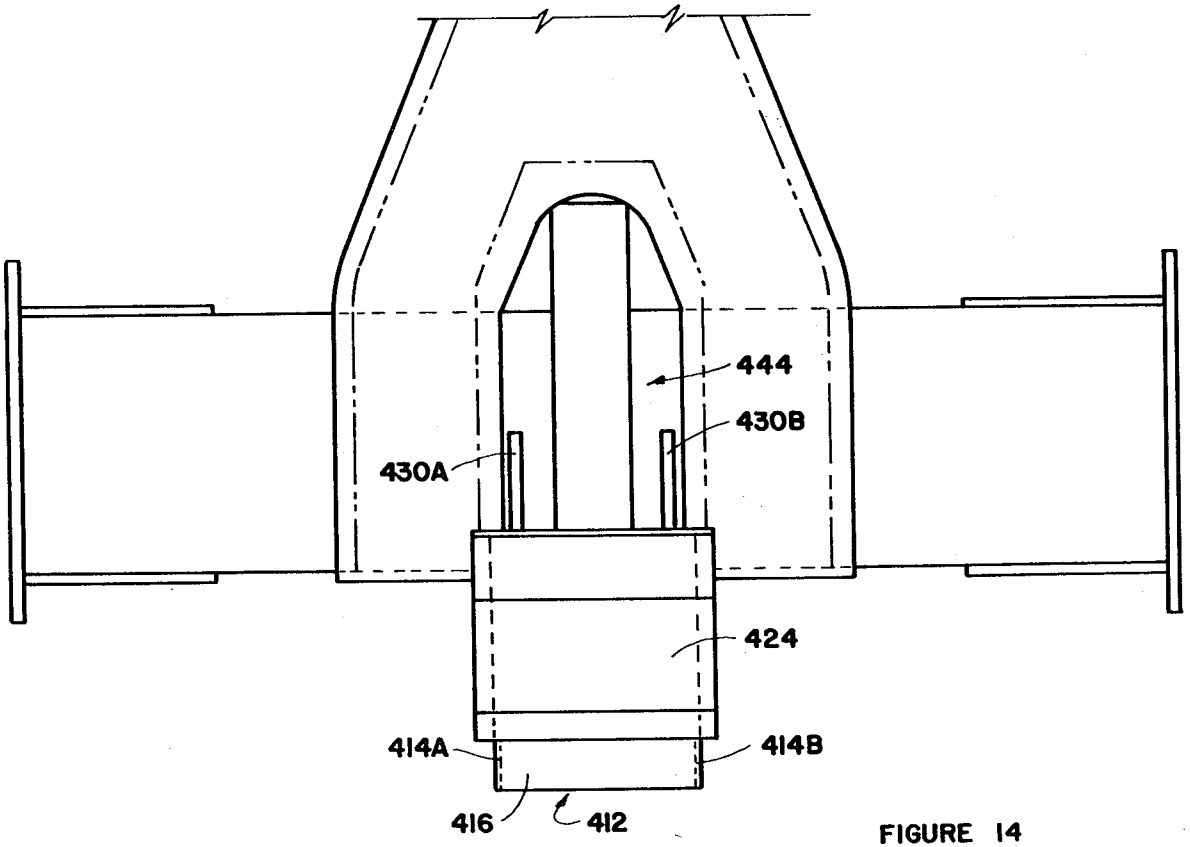
FIG. 14 is a plan view of the components of the ladle restraining means depicted in FIG. 12 and 13.

Referring to FIGS. 13 and 14, the ladle restraining means will be seen to be generally symmetrical about a longitudinal axis which, in the preferred embodiment as depicted, is coincident with the longitudinal axis 80 of the transporter 10. Components of such restraining means lying on one side of the axis will correspond to matched components on the other side thereof, and description of one component will be equally applicable to the matched component, unless noted to the contrary. Accordingly, when reference numbers are utilized which include the designation "A", this will refer to components relating to the left side of ladle restraining means and corresponding components will also exist for the right hand portion thereof. Similarly, reference numbers carrying the designation "B" will refer to corresponding components on the right hand portion thereof.

Figure 12:
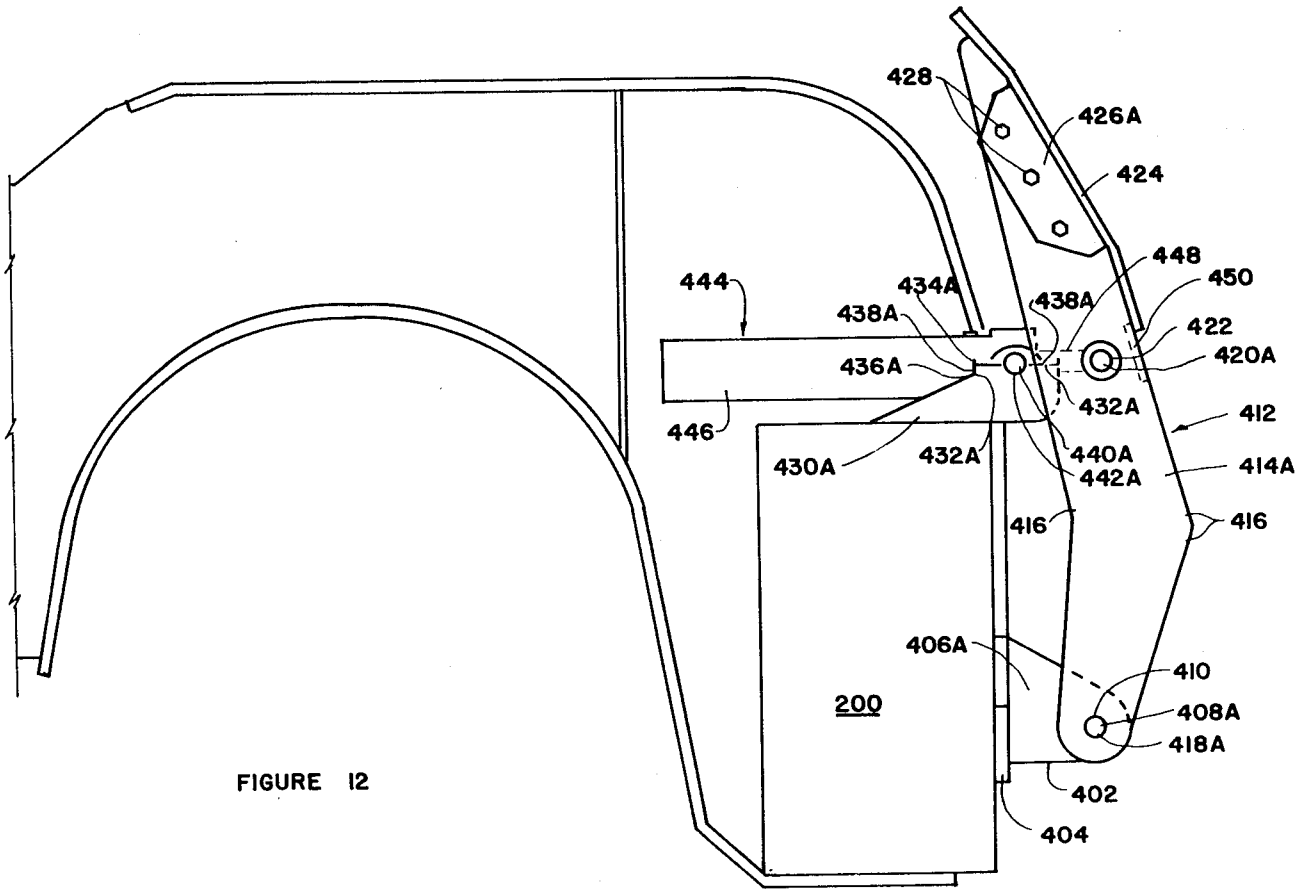
FIG. 12 is a side elevation view of components of the ladle restraining means.

With reference now to FIGS. 12 and 13, ladle restraining means will be seen to include mounting pad 402 rigidly attached to the main frame mid-section 200 by any convenient means such as bolting or welding. Mounting pad 402 comprises a backing plate 404 and a pair of parallel mounting plates 406A and 406B perpendicular to said backing plate and rigidly attached thereto. The parallel plates 406A and 406B include apertures 408A and 408B extending therethrough in coaxial alignment which receive pin 410.

Restraining arm 412 comprises identical parallel plates 414A and 414B, and a plurality of reinforcing plates 416 rigidly attached by welding or other convenient means between parallel plates 414A and 414B in perpendicular relationship thereto. Said parallel plates 414A and 414B include apertures 418A and 418B extending therethrough in coaxial alignment, and also in coaxial alignment with apertures 408A and 408B, so that pin 410 extends through apertures 418A, 408A, 408B and 418B so as to establish a pivotal relationship between mounting pad 402 and restraint arm 412 about 410. Restraint arm 412 also includes apertures 420A and 420B extending through parallel plates 414A and 414B, respectively, intermediate their length, with apertures 420A and 420B in coaxial alignment for receiving pin 422. Wear plate 424 is rigidly attached to restraint arm 412 at its end opposite apertures 418A and 418B, in perpendicular relationship with parallel plates 414A and 414B. Wear plate 424 is preferably attached to restraint arm 412 by means of mounting flanges 426A and 426B rigidly attached perpendicular to wear plate 424, which mounting flanges overlapping parallel plates 414A and 414B, and are secured thereto by a plurality of bolts 428 extending through coaxially aligned apertures in said mounting flanges and in said parallel plates 414A and 414B.

Ladle restraining means also includes a pillow block which comprises a pair of identical parallel plates 430A and 430B rigidly attached to the upper horizontal surface of main frame mid-section 200, as depicted in FIGS. 12, 13, and 14, preferably by welding or by any other convenient means such as bolts. Parallel plates 430A and 430B are themselves parallel to and symmetrical about the longitudinal axis 80 of transporter 10, and define a slot therebetween for receiving ladle restraint actuating means. Parallel plates 430A and 430B have substantially horizontal upper edges which, as illustrated for plates 430A in FIG. 12, include threaded apertures 432A and 432B extending into said plate near the respective ends of such upper horizontal edge to receive bolts 434A. The pillow block further comprises a pair of pin collars 436A and 436B removeably disposed upon the upper horizontal edges of plates 430A and 430B. Pin collars 436A and 436B, as illustrated for pin collar 436A in FIG. 12, include apertures 438A and 438B in coaxial alignment with apertures 432A and 432B, with bolts being inserted through apertures 432A and 432B and into apertures 438A and 438B, respectively, to firmly attach pin collars 436A and 436B to plates 430A and 430B, respectively. The pillow block also includes bifurcated apertures 440A and 440B centered upon the mating line between plates 430A and 430B and pin collars 436A and 436B, respectively, in coaxial alignment, to receive pins 442A and 442B.

Ladle restraining means further includes actuating means 444 disposed between plates 430A and 430B of the pillow block and pivotally mounted thereto by means of pins 442A and 442B which are rigidly attached to actuating means 444 on opposite sides of such actuating means. In the preferred embodiment, actuating means comprises hydraulic cylinder 446 and piston 448, with pins 442A and 442B attached to cylinder 446. Piston 448 extends between parallel plates 414A and 414B of restraint arm 412 and is pivotally attached thereto by means of pin 422, extending through apertures 420A and 420B and through the end of piston 448 distal from hydraulic cylinder 446. In the embodiment depicted in FIG. 12, the interconnection between piston 448 and restraint arm 412 is strengthened by reinforcing mount 450, firmly attached to appropriate reinforcing plate 416 and including apertures in coaxial alignment with apertures 420A and 420B which also receive pin 422.

Upon activation of actuating means 44 restraint arm 412 begins to rotate about pin 410, whereby wear plate 424 is moved toward the ladle pendantly disposed within the main frame of transporter 10. Continued activation of actuating means 444 will bring wear pad 424 into firm contact with the outer surface of the ladle. The ladle restraining means incorporates, in its preferred embodiment, an automatic hydraulic control and ladle swing damping system as hereinafter described with reference to FIGS. 15, 16, 17 and 18.

In the preferred embodiment, hydraulic cyclinder 446 includes two interconnections between such cylinder and the hydraulic control and damping system, one interconnection 502 for introduction of hydraulic fluid to cylinder 446 to effect extension of piston 448 and a second interconnection 504 for introduction of hydraulic fluid to cylinder 446 to effect retraction of piston 448. The operation of cylinder 446 and piston 448, as well as the purpose and operation of other components of the hydraulic system, including hydraulic pump (not shown), valve body 506, pilot control valve 508, hydraulic fluid reservoir (not shown), hydraulic hoses, hydraulic tubes, and interconnecting means are well known and understood in the art and need not be described herein. The automatic control and damping system additionally includes check valve assembly 510, accumulator 512, and pressure relief valve assembly 514, whose interrelated function in conjunction with the known and commonly utilized hydraulic components provides automatic control and ladle swing damping.

Upon activation of pilot control valve 508 to effectuate extension of piston 448, pressurized hydraulic fluid is introduced into hydraulic line 516, flows through such line, through check valve assembly 510, through T connection 518, through hydraulic line 520, and into hydraulic cylinder 446 to effectuate extension of piston 448 in the conventional manner. In like conventional manner, hydraulic fluid displaced by movement of piston 448 will flow through hydraulic line 522. Additionally, however, pressurized hydraulic fluid will flow from line 516, through T connection 518, through hydraulic line 524, through pressure relief valve assembly 514, and into accumulator 512. Accumulator 512 comprises a closed reservoir of preferably elongated cylindrical shape with walls and end closures of sufficient strength to withstand the internal pressures generated within the automatic control and damping system with a suitable safety factor. Accumulator 512 is disposed with its longitudinal axis vertical, upon main frame mid-section 200 in any convenient. protected location. Pressure relief valve assembly 514 is interconnected to the bottom end of accumulator 512 by conventional interconnection means.

At the time of the initial activation of pilot control valve 508 as described above, accumulator 512 is partially filled with hydraulic fluid and the balance of its internal volume above the hydraulic fluid level is filled with a compressible gas which is preferably insoluable in the hydraulic fluid. As hydraulic fluid enters accumulator 512 through pressure relief valve assembly 514, the enclosed gas is compressed, thereby "loading" the accumulator 512. Check valve assembly 510 includes an interconnecting tube 526 between hydraulic lines 516 and 522 which provides for interconnection between the portions of the hydraulic system bridged by piston 448 in cylinder 446. The check valve 510 may be pre-set to activate at a predetermined pressure, and upon such activation a fluid path between hydraulic lines 516 and 522 is established through tube 526, equalizing the pressure between such lines.

With activation of actuating means 444 as previously described, wear plate 424 will contact the outer surface of the ladle disposed within the mainframe of transporter 10, also as previously described, which resists further extension of piston 448 and restraint arm 424. Continued activation of actuator means will increase the force imposed upon the ladle with a corresponding increase of pressure in hydraulic line 516 and check valve 510. When the pressure in hydraulic line 516 and check valve 510 reaches the pre-set activation pressure of check valve 510, such valve will operate, establishing the fluid flow path through tube 526, preventing further pressure increase and maintaining the devised restraining force against the ladle as activation of actuating means 444 is ceased.

As forward movement of transporter 10 is initiated, the ladle pendantly disposed therefrom will tend to swing toward the rear of transporter 10. As the ladle swings it will move away from the rest position of restraint arm 412 and the pressure in the hydraulic system will decrease. Upon such pressure decrease the compressed gas in accumulator 512 will expand, forcing hydraulic fluid contained therein back through pressure relief valve assembly 514, through hydraulic lines 524 and 520 and into hydraulic cylinder 446, producing further extension of piston 448 and thus further rotation of restraint arm 412 so that wear plate 424 is maintained in constant contact with the ladle. As the ladle reverses its swing and moves toward the front of transporter 10 force is imposed upon wear plate 424, reversing the movement of components just described and thus forcing hydraulic fluid through the operative portion of the system into accumulator 512. Although system pressure will increase above the predetermined pressure for activation of check valve 510 as the ladle moves forward of its rest position, check valve 510 does not activate upon pressure imposed in reverse flow, thus preventing backflow through such valve and into tube 526. As hydraulic fluid enters accumulator 512 the gas contained therein is again compressed, thus offering increasing resistance to the flow of hydraulic fluid into accumulator 512 as pressure increases. Therefore further forward movement of the ladle and ladle restraint arm 412 will encounter increasing resistance to movement, producing a damping effect upon such movement. Overpressure of the control and damping system is prevented by pressure relief valve assembly 514, which may be preset to activate at a predetermined maximum pressure. Upon operation of the pressure relief valve hydraulic fluid is permitted to escape from the pressure relief valve assembly through hydraulic line 528, thus reducing the pressure of the system.

The main frame 16, as previously described, may be integrally fashioned of a one-piece construction or, may be provided in two section flanged together in rigid connection and will include any convenient hitch assembly for interconnecting the transporter 10 to the tractor 12. However, in the preferred embodiment described herein, with reference to FIG. 14, a main frame mid-section 200 is provided which will carry an appropriate hitch assembly and have rigidly connected to either end thereof the aforementioned first section 100A and 100B of the right and left hand halves of main frame assembly 16. This main frame mid-section 200 will include appropriate right and left hand flanges 202 and 204 adapted to matingly receive the flanges 106A and 106B of the corresponding respective first sections 100A and 100B of right and left hand halve sections of the frame assembly 16. In this manner, these flanges 202 and 204 by any convenient means such as bolts or the like.

Figure 15:
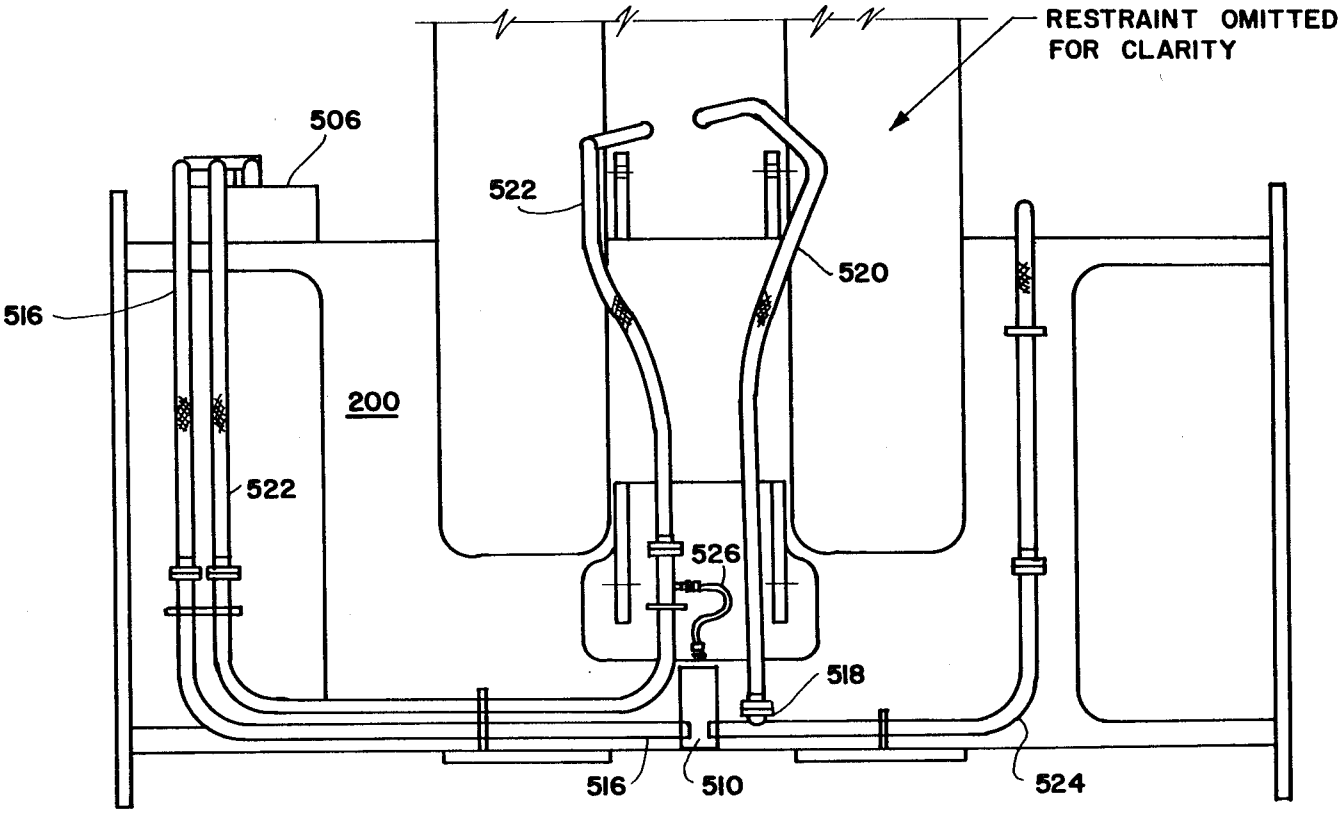
FIG. 15 is a front elevation view of hydraulic components of the ladle restraining means.
Figure 16:
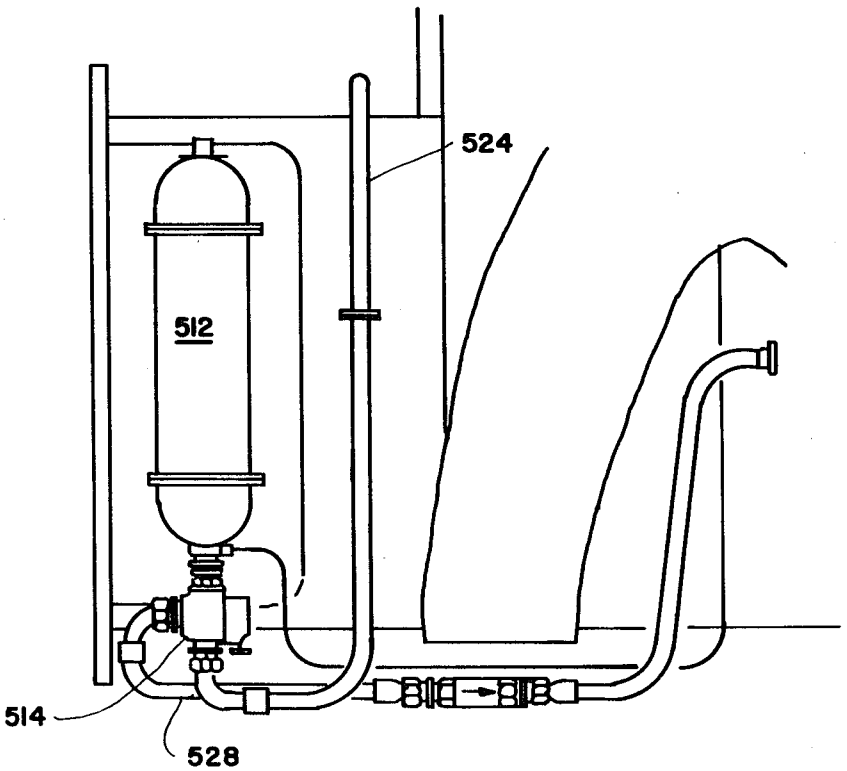
FIG. 16 is an elevation view of the accumulator and associated hydraulic components of the ladle restraining means.
Figure 17:
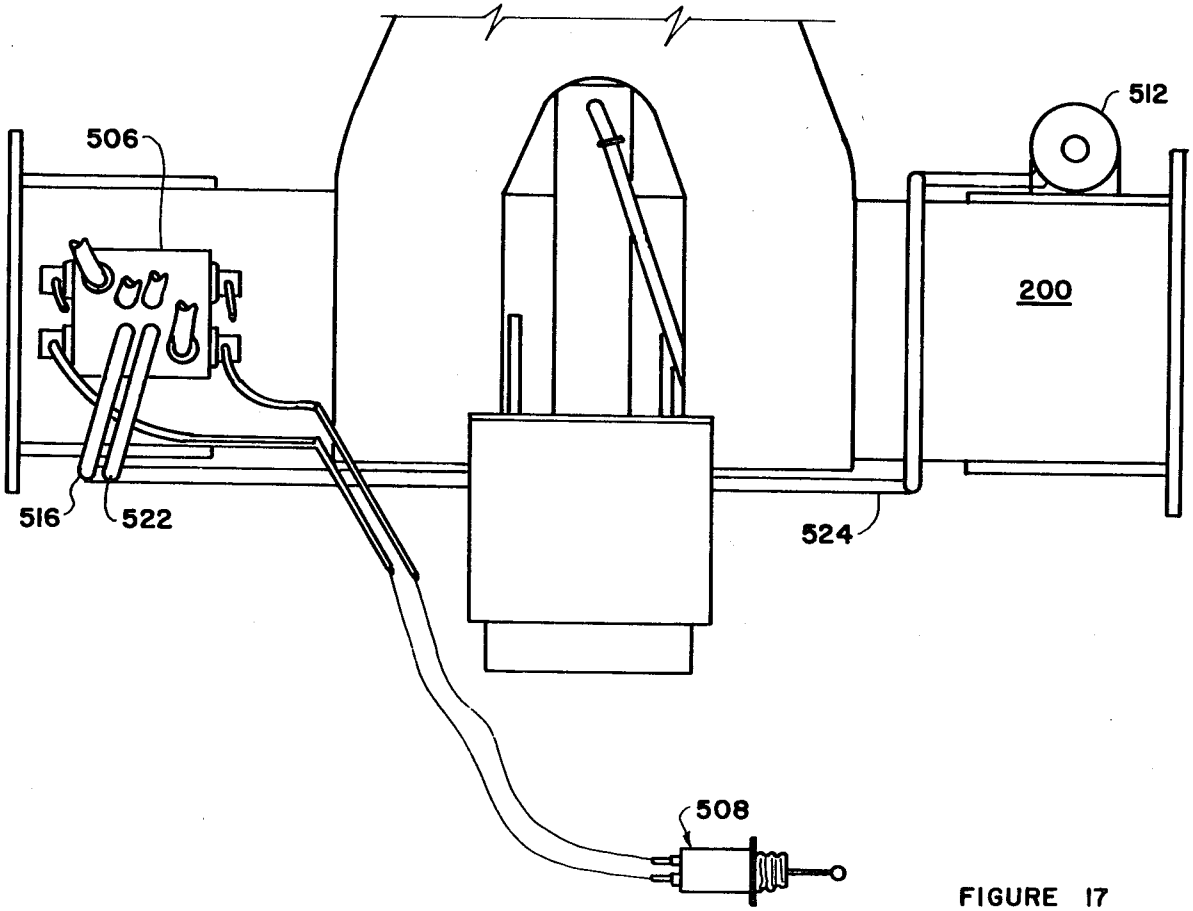
FIG. 17 is a plan view of hydraulic components of the ladle restraining means.
Figure 18:
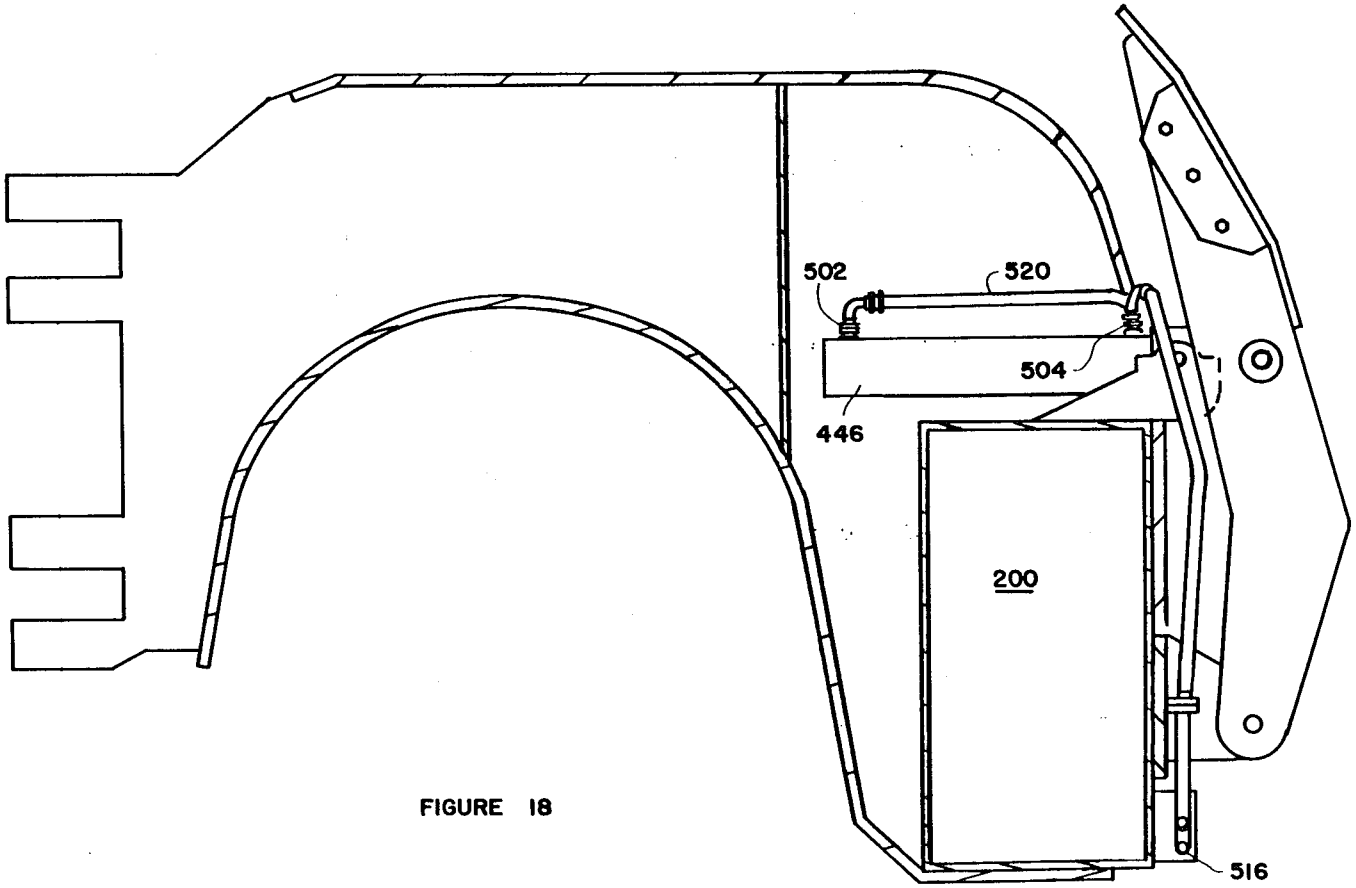
FIG. 18 is a side elevation view of the components of the ladle restraining means depicted in FIG. 12, with addition of certain hydraulic components of the ladle restraining means.
Figure 19:
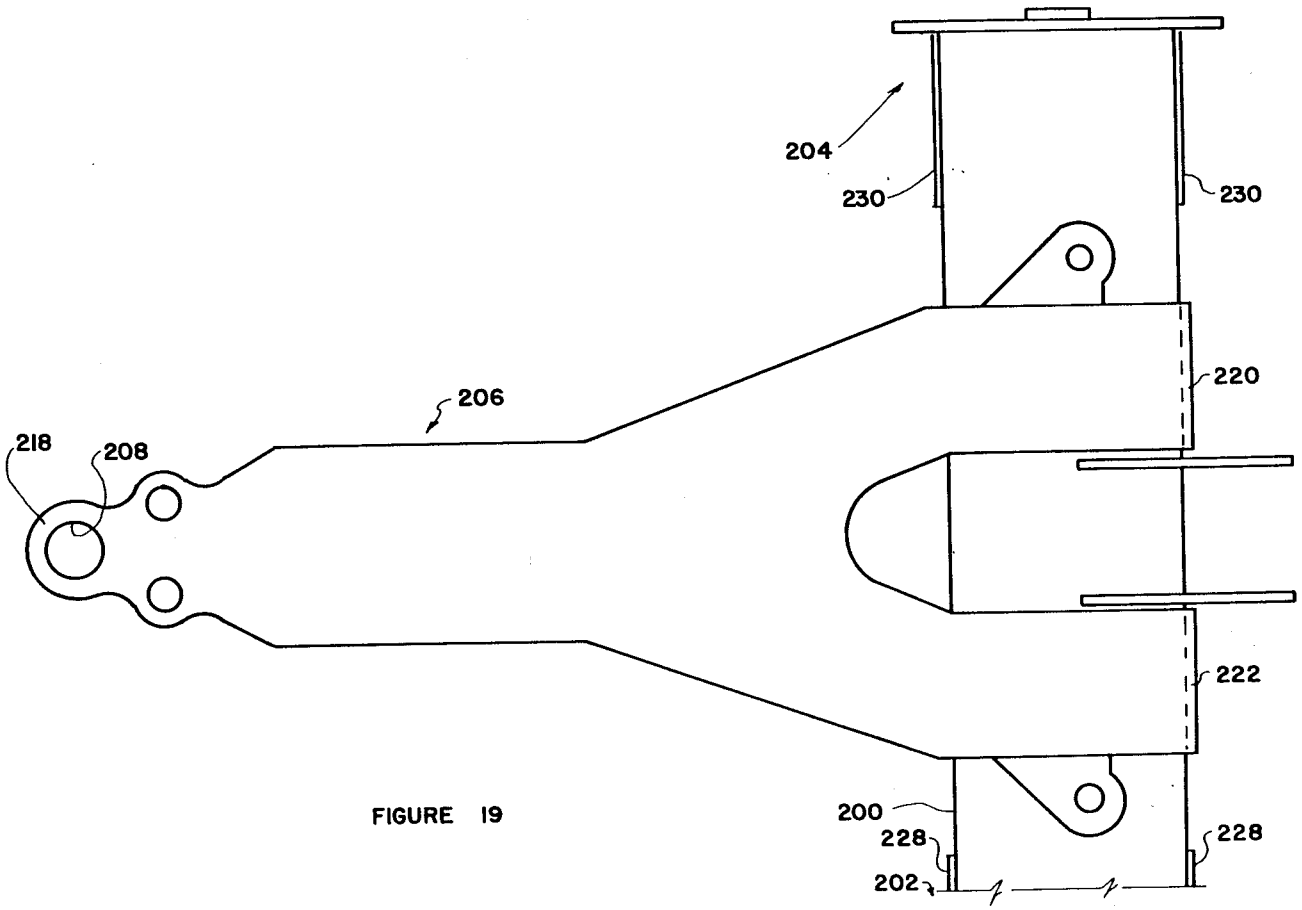
FIG. 19 is a plan view of the hitch assembly of the transporter depicted in FIG. 1.
Figure 20:
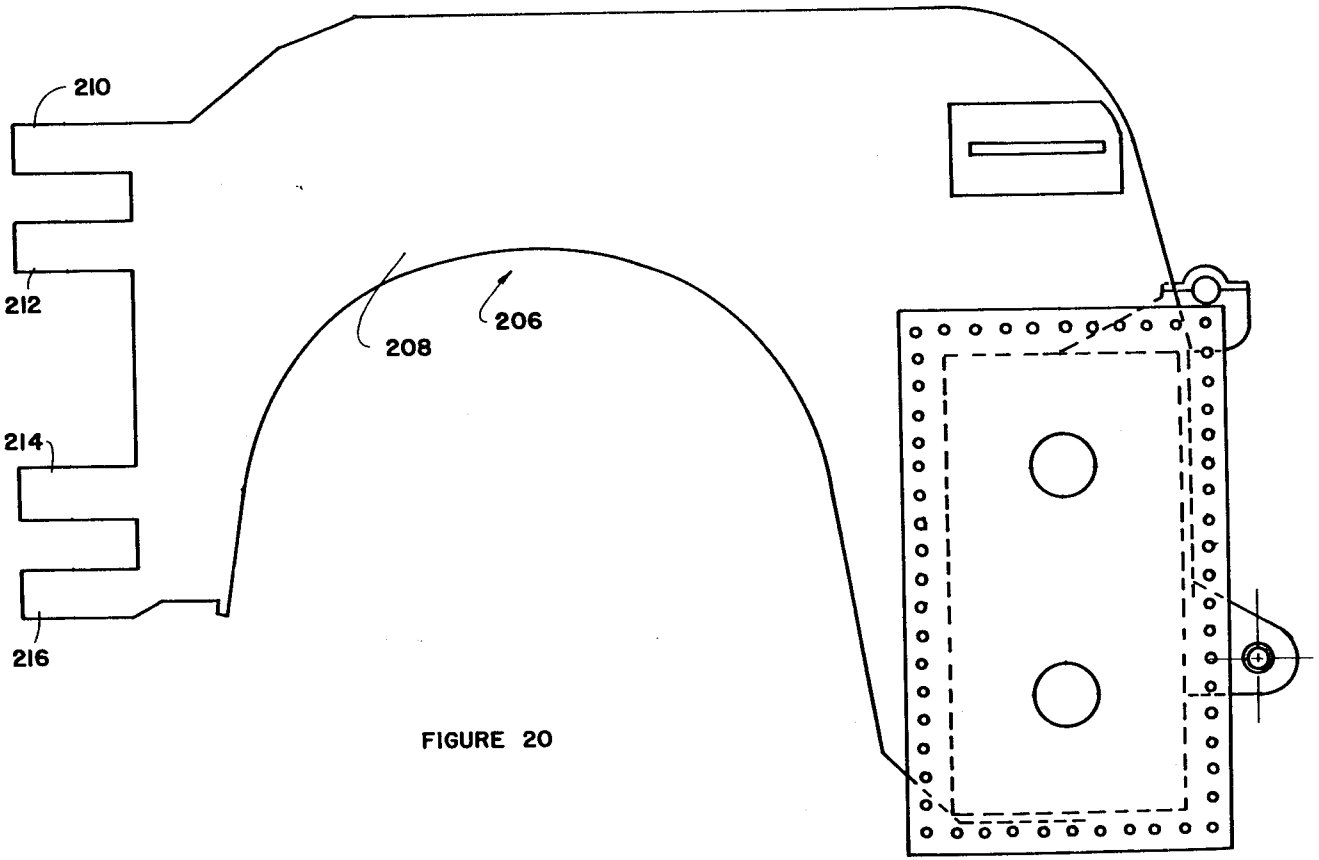
FIG. 20 is an elevational view of the hitch assembly of the transporter depicted in FIG. 1.
Figure 21:
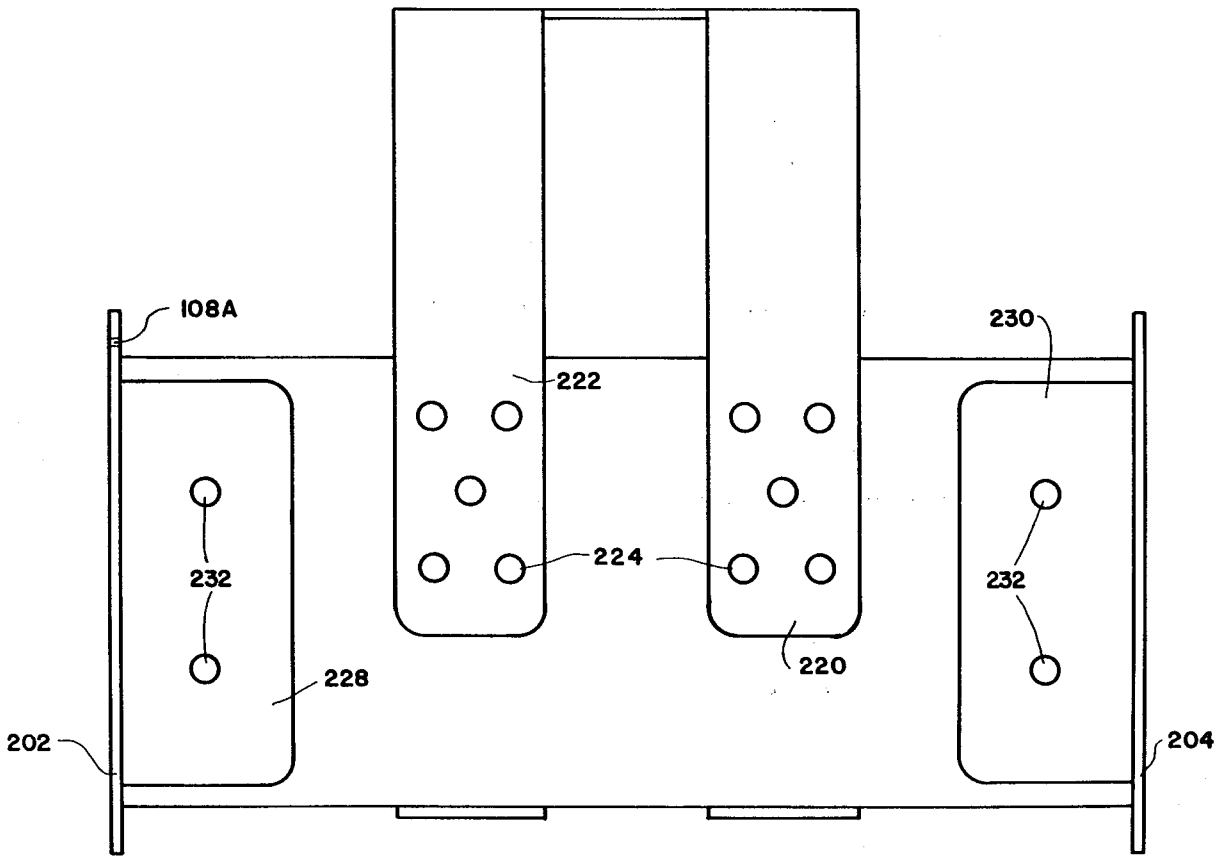
FIG. 21 is an end view of the hitch assembly of the transporter depicted in FIG. 1.

With reference to FIGS. 14 and 15, a typical gooseneck hitch assembly 206 may be seen depicted therein interconnected to the main frame mid-section 200. The hitch 206 will include a curve neck member 208 terminating in a plurality of vertically aligned ring members 210, 212, 214, and 216, each of such apertures define in vertical alignment a pin receiving slot 218 for receiving a mating portion of an appropriate hitch assembly attached to the tractor 12. Referring to FIG. 16, disposed at the other end of the curved member 208 are a pair of back brace members 220 and 222 which may be attached to the main frame mid-section 200 by any convenient means such as the bolts 224 depicted therein. In like manner, the flanges 202 and 204 may include side brace members 228 and 230, respectively which may, in like manner, be rigidly attached to the mid-section member 200 by means of bolts 232. By matingly interconnecting the ring members 210–216 to a similar member attached to the tractor 10 whereby the apertures are in vertical alignment to receive a hitch pin or the like, it will thus be appreciated that the tractor 12 and trailer 14 may be interconnected. Thus, tractor 12 and trailer 14 may pivot about the hitch assembly relative to one another in the horizontal plane so as to permit the positioning of the trailer 14 in desired locations along the horizontal plane. For example, trailer 14 may be backed about a ladle by tractor 12 in order to pick up and transport the ladle to the desired location.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. In a trailer interconnecting with a prime mover for transporting a container adapted to receive molten metal, having a main frame with a main member and two parallel side members, two carrier beams each having a pivotal connection to a different one of such side members of the main frame, actuator means for rotating each of such carrier beams about its pivotal connection to a respective side member of the main frame, an overhead beam assembly having an overhead beam and two parallel side beams each pivotally joined to a different one of such carrier beams, stabilizer means for maintaining the overhead beam assembly in substantially constant vertical alignment, container engagement means pendantly disposed from such overhead beam, container restraining means for maintaining the container in a stable position during movement of the trailer, two wheel assemblies each connected to a different one of the side members of the main frame, and hitch assembly means interconnected to the main member of the main frame, interconnecting means comprising:

gimbaling means for providing gimbaled interconnection between the actuator means and the main frame so as to allow said acutator means to independently rotate about two axes, with the first such axis being parallel to the plane of said main frame and the second such axis being perpendicular to said first such axis.

2. In a trailer interconnecting with a prime mover for transporting a container adapted to receive a molten metal, having a main frame with a main member and two parallel side members each having first and second ends and each having a pin column extending vertically from the second end, two carrier beams each having first and second ends, with the second end of each such carrier beam being pivotally connected to the second end of a different one of the side members of the main frame, actuator means for rotating said carrier beams about said pivotal connections, a U-shaped overhead beam assembly including two parallel side beams each pivotally joined to a respective different one of said carrier beams, and stabilizer means for maintaining the overhead beam assembly in substantially constant parallel alignment relative to a vertical plane perpendicular to the side members of the main frame during rotation of the carrier beams, wherein first ends of said stabilizer means pivotally interconnect to said pin columns and wherein said pivotal interconnection between said first ends of said stabilizer means and said pin columns and said pivotal interconnection between said carrier beams and said side members of said main frame are in vertical alignment.

3. In a trailer interconnecting with a prime mover for transporting a container adapted to receive molten metal, having a main frame with a main member and two parallel side members, two carrier beams each having a pivotal connection to a different one of such side members of the main frame, actuator means for rotating each of such carrier beams about its pivotal connection to a respective side member of the main frame, an overhead beam assembly having an overhead beam and two parallel side beams each pivotally joined to a different one of such carrier beams, stabilizer means for maintaining the overhead beam assembly in substantially constant vertical alignment, container engagement means pendantly disposed from such overhead beam, two wheel assemblies each connected to a different one of the side members of the main frame, and hitch assembly means interconnected to the main member of the main frame, container restraining means comprising:

a restraint arm pivotally connected at a first end to said main frame main member;

a wear plate firmly attached to a second end of said restraint arm for engaging said container upon rotation of said restraint arm about said pivotal connection; and restraint actuating means interconnected between said main frame main member and said restraint arm intermediate said first and second ends for rotating said restraint arm about said pivotal connection.

4. The trailer of claim 3, wherein said container restraining means further comprises:

restraint damping means for maintaining engagement between said wear plate and said container and damping movement of said container in the direction of the longitudinal axis of said trailer upon movement of said trailer.

5. The trailer of claim 4, wherein said restraint actuating means comprises a hydraulic piston-cylinder assembly.

6. A trailer interconnecting with a tractor for transporting a ladle adapted to receive molten metal by ladle trunnions, comprising:

a U-shaped main frame having a frame main member with first and second ends;

a first frame side member with first and second ends; and a second frame side member with first and second ends;

said first end of said first side member being rigidly interconnected to said first end of said main member and said first end of said second side member being rigidly interconnected to said second end of said main member;

a first carrier beam with first and second ends, said second end of said first carrier beam having a pivotal connection to said second end of said first side member;

a second carrier beam with first and second ends, said second end of said second carrier beam having a pivotal connection to said second end of said second side member;

first actuator means interconnected between said main frame and said first end of said first carrier beam for rotating said first carrier beam about said pivotal connection to said second end of said first side member;

second actuator means interconnected between said main frame and said first end of said second carrier beam for rotating said second carrier beam about said pivotal connection to said second end of said second side member;

a U-shaped overhead beam assembly having a beam main member with first and second ends;

a first beam assembly side member with first and second ends;

a second beam assembly side member with first and second ends;

said first end of said first beam assembly side member being rigidly interconnected to said first end of said beam main member;

said first end of said second beam assembly side member being rigidly interconnected to said second end of said beam main member;

said second end of said first beam assembly side member having a pivotal connection to said first carrier beam intermediate said first and second ends of said first carrier beam;

said second end of second beam assembly side member having a pivotal connection to said second carrier beam intermediate said first and second ends of said second carrier beam;

a first stabilizer rod having first and second ends, said first end of said first stabilizer rod having a pivotal connection to said first beam assembly side member intermediate said first and second ends of said first beam assembly side member;

said second end of said first stabilizer rod having a pivotal connection to said second end of said first frame side member;

a second stabilizer rod having first and second ends, said first end of said second stabilizer rod having a pivotal connection to said second beam assembly side member intermediate said first and second ends of said second beam assembly side member;

said second end of said second stabilizer rod having a pivotal connection to said second end of said second frame said member;

hook means pendantly disposed from said main member of said beam assembly for releasably engaging said trunnions of said ladle;

ladle restraining and damping means interconnected to said frame main member intermediate said first and second ends of said frame main member for releasably engaging said ladle;

first wheel assembly means interconnected to said first frame side member;

second wheel assembly means interconnected to said second frame side member; and hitch assembly means interconnected to said frame main member intermediate said first and second ends of said frame main member for releasably engaging said tractor.

7. The trailer of claim 6 further including:

first gimbal means interconnected to said first actuator means for providing gimbaled interconnection of said first actuator means between said main frame and said first end of said first carrier beam; and second gimbal means interconnected to said second actuator means for providing gimbaled interconnection of said second actuator means between said main frame and said second end of said second carrier beam.

8. The trailer of claim 7 wherein said hook means comprises a pair of trunnion hooks disposed from said beam main member in opposed relation on either side of a longitudinal axis bisecting said trailer.

9. The trailer of claim 7 wherein said first and second gimbaling means permit movement of said first and second actuator means parallel and perpendicular to a plane including said longitudinal axis.

10. The trailer of claim 7 wherein, said first actuator means comprises a hydraulic pistoncylinder assembly, and said second actuator means comprises a hydraulic piston-cylinder assembly.

11. The trailer of claim 9 wherein when said first and second carrier beams are aligned parallel to respective ones of said first and second frame side members, said pivotal interconnection between said first stabilizer rod and said first beam assembly side member is at a first location intermediate said pivotal interconnection between said second end of said first beam assembly side member to said first carrier beam and said pivotal interconnection between said first stabilizer rod and said second end of said first frame side member; and said pivotal interconnection between said second stabilizer rod and said second beam assembly side member is at a first location intermediate said pivotal interconnection between said second end of said second beam assembly side member to said second carrier beam and said pivotal interconnection between said second stabilizer rod and said second end of said second frame side member.

12. The trailer of claim 6 wherein said ladle restraining and damping means comprises:

a restraint arm having first and second ends, said first end being pivotally connected to said frame main member intermediate its said first and second ends;

a wear plate rigidly attached to said second end of said restraint arm for releasably contacting the body of said ladle when engaged by said hook means, upon rotation of said restraint arm about said pivotal connection;

a hydraulic piston-cylinder restraint actuating means interconnected between said frame main member and said restraint arm intermediate said first and second ends for rotating said restraint arm about said pivotal connection;

a source of pressurized hydraulic fluid having a first fluid flow interconnection to said restraint actuating means for extension of said hydraulic piston and having a second fluid flow interconnection to said restraint actuating means for retraction of said hydraulic piston; and restraint control and damping means interconnected to said first fluid flow interconnection between said source of pressurized hydraulic fluid and said restraint actuating means for maintaining the force between said wear plate and said ladle within predetermined limits upon activation of said ladle restraining means and subsequent movement of said trailer along said ground.

13. The trailer of claim 12, wherein said restraint control and damping means comprises:

a fluid flow branching means in said first fluid flow interconnection between said source of pressurized hydraulic fluid and said restraint actuating means;

a pneumatic pressure accumulator means; and a pressure relief valve assembly having a first fluid flow interconnection between said fluid flow branching means and said pressure accumulator means through said pressure relief valve assembly, and having a second fluid flow interconnection between said fluid flow branching means and said second fluid flow interconnection between said source of pressurized hydraulic fluid and said restraint actuating means, through said pressure relief valve assembly.

14. A trailer interconnecting with a tractor for transporting a ladle adapted to receive molten metal by ladle trunnions, comprising:

a U-Shaped main frame having a frame main member with first and second ends;

a first frame side member with first and second ends; and a second frame side member with first and second ends;

said first end of said first frame side member being rigidly interconnected to said first end of said frame main member and said first end of said second frame side member being rigidly interconnected to said second end of said frame main member a first carrier beam with first and second ends, said first end of said first carrier beam having a pivotal connection to said first end of said first frame side member;

a second carrier beam with first and second ends, said first end of said second carrier beam having a pivotal connection to said first end of said second frame side member;

first hydraulic actuator means interconnected between said main frame and said second end of said first carrier beam for rotating said first carrier beam about said pivotal connection to said first end of said first frame side member;

second hydraulic actuator means interconnected between said main frame and said second carrier beam about said pivotal connection to said first end of said second frame side member;

first gimbal means interconnecting said first hydraulic actuator means to said main frame to permit concurrent rotation of said first hydraulic actuator means about a first actuator axis perpendicular to the longitudinal axis of said trailer and about a second actuator axis parallel to the longitudinal axis of said trailer;

second gimbal means interconnecting said second hydraulic actuator means to said main frame to permit concurrent rotation of said second hydraulic actuator means about said first actuator axis and about a third actuator axis parallel to the longitudinal axis of said trailer;

a U-shaped overhead beam assembly having a beam main member with first and second ends;

a first beam assembly side member with first and second ends;

a second beam assembly side member with first and second ends;

said first end of said first beam assembly side member being rigidly interconnected to said first end of said beam main member;

said first end of said second beam assembly side member being rigidly interconnected to said second end of said beam main member said second end of said first beam assembly side member having a pivotal connection to said first carrier beam intermediate said first and second ends of said first carrier beam;

said second end of said second beam assembly side member having a pivotal connection to said second carrier beam intermediate said first and second ends of said second carrier beam;

a first stabilizer rod having first and second ends, said first end of said first stabilizer rod having a pivotal connection to said first beam assembly side member intermediate said first and second ends of said first beam assembly side member;

said second end of said first stabilizer rod having a pivotal connection to said first end of said first frame side member;

a second stabilizer rod having first and second ends, said first end of said second stabilizer rod having a pivotal connection to said second beam assembly side member intermediate said first and second ends of said second beam assembly side member;

said second end of said second stabilizer rod having a pivotal connection to said first end of said second frame side member;

a pair of trunnion hooks pendantly disposed from said beam main member of said beam assembly in opposed relation on either side of a longitudinal axis bisecting said trailer for releasably engaging said trunnions of said ladle;

a ladle restraining and damping means having a restraint arm pivotally connected at one of its two ends to said main member intermediate its ends;

a wear plate firmly attached to the second end of said restraint arm;

a hydraulic piston-cylinder restraint actuating means interconnected between said frame main member and said restraint arm intermediate its ends; and an hydraulic actuator control and damping means including a source of pressurized hydraulic fluid, a first interconnection between said source of said pressurized hydraulic fluid and said restraint actuating means for extension of the piston, a second interconnection between said source of said pressurized hydraulic fluid and said restraint actuating means for retraction of the piston, a pressure relief valve assembly for equalizing pressure between said first and second interconnections, and a pressure accumulator means for damping movement of said restraint arm about a rest position;

first wheel assembly means interconnected to said first frame side member;

second wheel assembly means interconnected to said second frame side member; and hitch assembly means interconnect to said frame main member intermediate said first and second ends of said frame main member for releasably engaging said tractor.

* * * * *